US009482244B2

(12) United States Patent
Leonard

(10) Patent No.: US 9,482,244 B2
(45) Date of Patent: Nov. 1, 2016

(54) PNEUMATIC MEMBRANE ACTUATOR AND METHOD OF ASSEMBLY

(75) Inventor: Joshua R. Leonard, Noblesville, IN (US)

(73) Assignee: Firestone Industrial Products Company, LLC, Indianapolis, IN (US)

( * ) Notice: Subject to any disclaimer, the term of this patent is extended or adjusted under 35 U.S.C. 154(b) by 678 days.

(21) Appl. No.: 13/878,962

(22) PCT Filed: Oct. 12, 2010

(86) PCT No.: PCT/US2010/052289
§ 371 (c)(1),
(2), (4) Date: Apr. 11, 2013

(87) PCT Pub. No.: WO2012/050565
PCT Pub. Date: Apr. 19, 2012

(65) Prior Publication Data
US 2013/0192455 A1 Aug. 1, 2013

(51) Int. Cl.
*F16J 3/00* (2006.01)
*F15B 15/10* (2006.01)
*B66F 3/35* (2006.01)

(52) U.S. Cl.
CPC ..... *F15B 15/10* (2013.01); *B66F 3/35* (2013.01); *F15B 15/103* (2013.01); *Y10T 29/49826* (2015.01)

(58) Field of Classification Search
CPC ..... F15B 15/10; B66F 3/35; B66F 3/40
See application file for complete search history.

(56) References Cited

U.S. PATENT DOCUMENTS 6,513,418 B1 2/2003 Simmons et al.
6,612,223 B2 9/2003 Leonard et al.
6,647,860 B2 * 11/2003 Savel ..... F16J 3/02 92/101
7,270,317 B2 9/2007 Leonard

FOREIGN PATENT DOCUMENTS

DE 203 10 612 U1 10/2003
EP 0 903 317 A1 3/1999

OTHER PUBLICATIONS

International Search Report.

* cited by examiner

*Primary Examiner* — Michael Leslie
(74) *Attorney, Agent, or Firm* — Thomas R. Kingsbury; Fay Sharpe LLP

(57) ABSTRACT

A pneumatic actuator is operable between an extended condition and a collapsed condition, and is capable of displacing a workpiece during movement between the extended and collapsed conditions. The pneumatic actuator can include a flex member (202) and a mounting base (204). The flex member can include a flexible wall (208) with a mounting bead (222). The mounting base can include a base portion (266) and a bead portion (268), and can be operatively connected along the flex member such the mounting bead is at least partially captured between the bead portion and the base portion. In this manner, a substantially fluid-tight seal can be formed and an actuator chamber can be at least partially defined between the flex member and the mounting base. An actuator support pad can receive and abuttingly engage at least a portion of the pneumatic actuator. A method of assembly is also included.

20 Claims, 20 Drawing Sheets

PNEUMATIC MEMBRANE ACTUATOR AND METHOD OF ASSEMBLY

BACKGROUND

The subject matter of the present disclosure broadly relates to the art of actuating devices and, more particularly, to pneumatic actuators that include a flex member with a mounting bead and a mounting base with a base portion and a bead portion. In one case, the mounting bead can be at least partially captured between the bead portion and the base portion such that a substantially fluid-tight seal is formed between the mounting base and the flex member. Support pads, pneumatic actuator and support pad assemblies as well as methods of assembly are also provided.

Pneumatic actuators of a variety of types, kinds and constructions are well known and commonly used. Examples of some known constructions are shown and described in: U.S. Pat. No. 6,513,418 to Simmons et al., which describes a pneumatic actuator that includes a hollow body and a fluid connector; U.S. Pat. No. 6,612,223 to Leonard et al., which describes a pneumatic actuator that includes a rigid base and a flexible top member secured together with a welded joint; and, U.S. Pat. Nos. 7,270,317 and 7,543,804 to Leonard, which describe a pneumatic actuator with a flexible wall, a connector fitting in the flexible wall and a groove formed along the flexible wall adjacent the connector fitting.

Notwithstanding the widespread usage and overall success of pneumatic actuators of known types, kinds and constructions, such as are listed above, for example, it is believed that the further development of pneumatic actuator constructions may be beneficial in advancing the art of actuating devices.

Accordingly, it is believed desirable to develop pneumatic actuators as well as pneumatic actuator and support pad assemblies, support pads for pneumatic actuators and methods of assembly that further contribute to the art of actuating devices.

SUMMARY OF THE INVENTION

One example of a pneumatic actuator in accordance with the subject matter of the present disclosure that is operable between an extended condition and a collapsed condition can include a flex member and a mounting base. The flex member can include a central axis and a flexible wall formed from a polymeric material. The flexible wall can include a central portion that is disposed in transverse relation to the central axis and that at least partially defines a closed end of the flex member. A side portion can be spaced radially-outwardly from the central portion and can extend in approximate alignment with the central axis such that an open end of the flex member is at least partially defined thereby. An end surface can be formed along the open end of the flex member and can be disposed in transverse relation to the central axis. A mounting bead can be spaced radially-outwardly from the side portion and can at least partially define an outermost periphery of the flex member. The mounting bead can include a bead recess surface extending radially-outwardly from along the side portion and a bead projection surface extending radially-outwardly from along the bead recess surface. The bead recess surface can be disposed in spaced relation to the end surface such that a recess dimension is formed therebetween. The bead projection surface can be disposed in spaced relation to the end surface such that a projection dimension is formed therebetween. The projection dimension can be greater than the recess dimension such that a mounting recess is at least partially defined by the bead recess surface. The mounting recess can extend along the flexible wall about the central axis. The mounting base can be operatively connected along the flex member such that a substantially fluid-tight seal is formed therewith along the end surface thereof and such that an actuator chamber is at least partially defined between the flex member and the mounting base. The mounting base can include a base portion disposed in transverse relation to the central axis of the flex member and can include a bead portion that extends along the base portion about the central axis of the flex member. The bead portion can be received within the mounting recess and can abuttingly engage at least a part of the bead recess surface of the flex member. In this manner, at least a portion of the end surface of the flex member can be urged toward and into abutting engagement with the base portion of the mounting base to form the substantially fluid-tight seal therebetween.

A pneumatic actuator according to the foregoing paragraph can be provided, wherein the mounting bead includes an outer bead side surface extending in approximate alignment with the central axis and intersecting with the end surface.

A pneumatic actuator according to either of the foregoing two paragraphs can be provided, wherein the flexible wall of the flex member includes a first annular convolution extending radially-outwardly from along the central portion and a second annular convolution extending radially between the first annular convolution and the side portion.

A pneumatic actuator according to the foregoing paragraph can be provided, wherein the first annular convolution includes a closed end disposed toward the mounting base and an open end disposed away from the mounting base, and the second annular convolution includes an open end disposed toward the mounting base and a closed end disposed away from the mounting base.

A pneumatic actuator according to any one of the foregoing four paragraphs can be provided that further comprises a support structure disposed within the actuator chamber. The support structure can be disposed along the base portion and operative to abuttingly engage the central portion of the flex member in the collapsed condition.

A pneumatic actuator according to any one of the foregoing five paragraphs can be provided, wherein the base portion includes a first side disposed in abutting engagement with the end surface of the flex member and an opposing second side. The mounting base can include at least one securement feature disposed along the base portion with the at least one securement feature being accessible from along at least the second side of the base portion. The mounting base can also include a base plate that is disposed along the second side of the base portion. The base plate can include at least one securement feature that is cooperable with the at least one securement feature disposed along the base portion such that the base plate can be operatively connected in abutting engagement with the base portion.

A pneumatic actuator according to any one of the foregoing six paragraphs can be provided, wherein the polymeric material of the base portion is a thermoplastic elastomer having a durometer within a range of approximately 60 Shore A hardness to approximately 70 Shore D hardness.

A pneumatic actuator according to any one of the foregoing seven paragraphs can be provided, wherein the base portion and the bead portion of the mounting base are formed from a unitary section of metal material, and the bead portion is formed from an outermost peripheral portion of the section of metal material.

A pneumatic actuator according to any one of the foregoing eight paragraphs can be provided, wherein the base portion of the mounting base is formed from a polymeric material having a durometer greater than approximately 60 Shore A hardness.

A pneumatic actuator according to any one of the foregoing nine paragraphs can be provided, wherein the flex member includes a sealing feature projecting outwardly from the end surface, and the sealing feature abuttingly engages the base portion of the mounting base.

A pneumatic actuator according to any one of the foregoing ten paragraphs can be provided, wherein the base portion includes a first side disposed in abutting engagement with the end surface of the flex member and an opposing second side, and the mounting base includes at least one securement feature disposed along the base portion and accessible from along east one of the first and second sides of the base portion.

A pneumatic actuator according to the foregoing paragraph can be provided, wherein the at least one securement feature includes a threaded boss operatively connected in a substantially fluid-tight manner along the base portion. The threaded boss can include a closed end disposed within the actuator chamber and an open end accessible from along the second side of the base portion.

A pneumatic actuator according to one of the foregoing two paragraphs can be provided, wherein the mounting base includes bead ring that is separable from the base wall. The bead ring can include the bead portion and at least one securement feature that is cooperable with the at least one securement feature disposed along the base portion such that the bead ring can be operatively connected with the base portion and thereby urge the end surface of the flex member into abutting engagement with the base portion of the mounting base to form the substantially fluid-tight seal therebetween.

A pneumatic actuator according to any one of the foregoing thirteen paragraphs can be provided, wherein the flex member includes a connector wall projecting outwardly from along the flexible wall with the connector wall at least partially defining a fluid passage.

A pneumatic actuator according to the foregoing paragraph can be provided, wherein the flex member includes a plurality of connector walls projecting outwardly from along the flexible wall with each of the plurality of connector walls at least partially defining a fluid passage and with at least one fluid passage in fluid isolation from the actuator chamber.

A pneumatic actuator according to one of the foregoing two paragraphs can be provided, wherein the fluid passage extends through the flexible wall and into fluid communication with the actuator chamber.

A pneumatic actuator according to one of the foregoing three paragraphs can be provided, wherein the fluid passage terminates at the flexible wall such that the fluid passage is fluidically isolated from the actuator chamber.

A pneumatic actuator according to any one of the foregoing seventeen paragraphs can be provide that further comprise a support pad abuttingly engaging the mounting base.

A pneumatic actuator according to the foregoing paragraph can be provided, wherein the support pad includes a support pad wall at least partially defining a support pad cavity within the support pad that is dimensioned to receive the mounting base of the pneumatic actuator.

A pneumatic actuator according to the foregoing paragraph can be provided, wherein the mounting base includes an outer surface and the support pad wall includes a base portion and a side portion. The base portion can include an outer surface and an opposing inner surface. The side portion can project from along the base portion in a direction opposite the outer surface. The side portion can include an outer surface and an inner surface with the inner surface of the base portion and the outer surface of the mounting base disposed in facing relation to one another.

One example of a pneumatic actuator and support pad assembly in accordance with the subject matter of the present disclosure can include a pneumatic actuator and a support pad assembly. The pneumatic actuator can include a flex member and a mounting base. The flex member can include a central axis and a flexible wall formed from a polymeric material. The flexible wall can include a central portion, a side portion, an end surface and a mounting bead. The central portion can be disposed in transverse relation to the central axis and can at least partially define a closed end of the flex member. The side portion can be spaced radially-outwardly from the central portion and can extend in approximate alignment with the central axis such that an open end of the flex member is at least partially defined by the side portion. The end surface can be formed along the open end of the flexible wall and can be disposed in transverse relation to the central axis. The mounting bead can be spaced radially-outwardly from the side portion and can least partially define an outermost periphery of the flex member. The mounting bead can include a bead recess surface extending radially-outwardly from along the side portion and a bead projection surface extending radially-outwardly from along the bead recess surface. The bead recess surface can be disposed in spaced relation to the end surface such that a recess dimension is formed therebetween and the bead projection surface can be disposed in spaced relation to the end surface such that a projection dimension is formed therebetween. The projection dimension can be greater than the recess dimension such that a mounting recess is at least partially defined by the bead recess surface. The mounting recess can extend along the flexible wall about the central axis. The mounting base can be operatively connected along the flex member such that a substantially fluid-tight seal is formed therewith along the end surface thereof and such that an actuator chamber is at least partially defined between the flex member and the mounting base. The mounting base can include a base portion and a bead portion. The base portion can be disposed in transverse relation to the central axis of the flex member. The bead portion can extend along the base portion about the central axis of the flex member. At least a part of the bead portion can be received within the mounting recess and can abuttingly engage at least a part of the bead recess surface of the flex member such that at least a part of the end surface of the flex member is urged toward and into abutting engagement with the base portion of the mounting base to form the substantially fluid-tight seal between the flex member and the mounting base. The support pad can abuttingly engage at least a portion of the pneumatic actuator. The support pad can include a support pad wall. The support pad wall can include a base portion and a side portion projecting axially from along the base portion. The base portion can include an outer surface adapted to abuttingly engage an associated support surface and an inner surface disposed opposite the outer surface. The side portion can include an outer surface and an opposing inner surface. The inner surface of the base portion and the inner surface of the side portion can together at least partially define a support pad cavity of the support pad. At least a portion of the pneumatic actuator can be received within the support pad cavity of the support pad such that at least a portion of the mounting base abuttingly engages at least a portion of the inner surface of at least one of the base portion and the side portion of the support pad wall.

A pneumatic actuator and support pad assembly according to the foregoing paragraph can be provided, wherein the base portion includes a first side disposed in abutting engagement with the end surface of the flex member and an opposing second side. The mounting base can include at least one securement feature that is disposed along the base portion and accessible from along at least the second side of the base portion. The at least one securement feature can include a threaded boss that is operatively connected in a substantially fluid-tight manner along the base portion. The threaded boss can include a closed end disposed within the actuator chamber and an open end accessible from along the second side of the base portion.

A pneumatic actuator and support pad assembly according to one of the foregoing two paragraphs can be provided, wherein the support pad wall includes a tab portion projecting radially-outwardly beyond the outer surface of the side portion. The tab portion can include an opening extending therethrough.

A pneumatic actuator and support pad assembly according to the foregoing paragraph can be provided, wherein the opening extending through the tab portion has an elongated shape with a width and a length that is greater than the width such that the opening is dimensioned to at least partially define a handle along the tab portion.

A pneumatic actuator and support pad assembly according to one of the foregoing two paragraphs can be provided, wherein the opening extending through the tab portion has an approximately circular cross-sectional shape such that the opening is dimensioned to receive an associated fastener for securing the support pad along the associated support surface.

A pneumatic actuator and support pad assembly according to the foregoing paragraph can be provided, wherein the tab portion is one of a plurality of tab portions disposed peripherally about the side portion of the support pad wall.

A pneumatic actuator and support pad assembly according to one of the foregoing six paragraphs can be provided, wherein the support pad wall includes at least one access passage extending therethrough such that at least a portion of the mounting base is accessible through the at least one access passage.

A pneumatic actuator and support pad assembly according to the foregoing paragraph can be provided, wherein the pneumatic actuator includes a connector fitting operatively connected thereto along the mounting base. The connector fitting including a fitting passage in fluid communication with the actuator chamber and dimensioned to receive and releasably engage a connector wall.

A pneumatic actuator and support pad assembly according to the foregoing paragraph can be provided, wherein the connector wall extends from the base portion of the mounting base and the at least one access passage is disposed adjacent the connector wall thereby providing access to the connector fitting to release the connector wall therefrom.

One example of a method of assembling a pneumatic actuator in accordance with the subject matter of the present disclosure can include providing a flex member that includes a central axis and a flexible wall formed from a polymeric material. The flexible wall can include a central portion disposed in transverse relation to the central axis. The central portion can at least partially define a closed end of the flex member. A side portion can be spaced radially-outwardly from the central portion and can extend in approximate alignment with the central axis such that an open end of the flex member is at least partially defined thereby. An end surface can be formed along the open end of the flex member and can be disposed in transverse relation to the central axis. A mounting bead can be spaced radially-outwardly from the side portion and can at least partially define an outermost periphery of the flex member. The mounting bead can include a bead recess surface that extends radially-outwardly from along the side portion and a bead projection surface that extends radially-outwardly from along the bead recess surface. The bead recess surface can be disposed in spaced relation to the end surface such that a recess dimension is formed therebetween. The bead projection surface can be disposed in spaced relation to the end surface such that a projection dimension is formed therebetween. The projection dimension can be greater than the recess dimension such that a mounting recess can be at least partially defined by the bead recess surface. The mounting recess can extend along the flexible wall about the central axis. The method can also include providing a mounting base that includes a base portion and a bead portion that extends peripherally along the base portion. The method can further include positioning the mounting base such that the base portion is disposed adjacent the end surface of the flex member. The method can also include positioning the bead portion of the mounting base within the mounting recess of the flexible wall. The method can further include urging at least a part of the bead portion toward the base portion such that at least a part of the mounting bead is captured between the bead portion and the base portion and a substantially fluid-tight seal formed between the end surface and the base portion with an actuator chamber at least partially defined between the flex member and the mounting base.

A method according to the foregoing paragraph can be provided, wherein the action of urging includes abuttingly engaging at least a portion of the bead portion with at least a portion of the bead recess surface.

A method according to either one of the foregoing two paragraphs can be provided, wherein the action of providing a flex member includes providing a sealing feature along the end surface, and the action of urging includes urging the sealing feature into abutting engagement with the base portion.

A method according to any one of the foregoing three paragraphs can be provided, wherein the action of providing a flex member includes providing a connector wall projecting outwardly from said flexible wall with the connector wall at least partially defining a fluid passage disposed in fluid communication with the actuator chamber.

DETAILED DESCRIPTION

Figure 1:
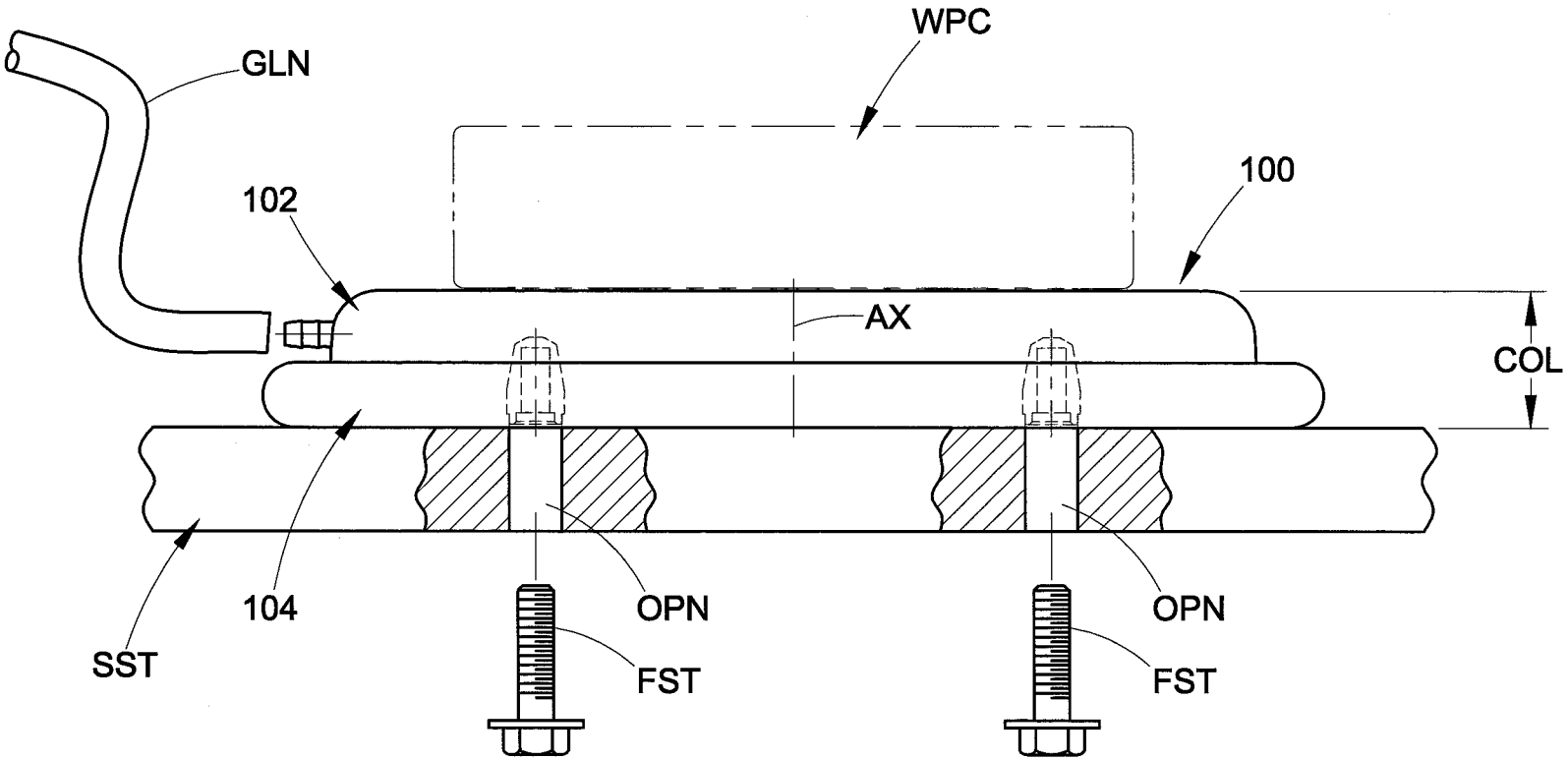
FIG. 1 is a side elevation view of one example of a pneumatic actuator in accordance with the subject matter of the present disclosure shown in a collapsed condition and supporting an associated work piece.
Figure 2:
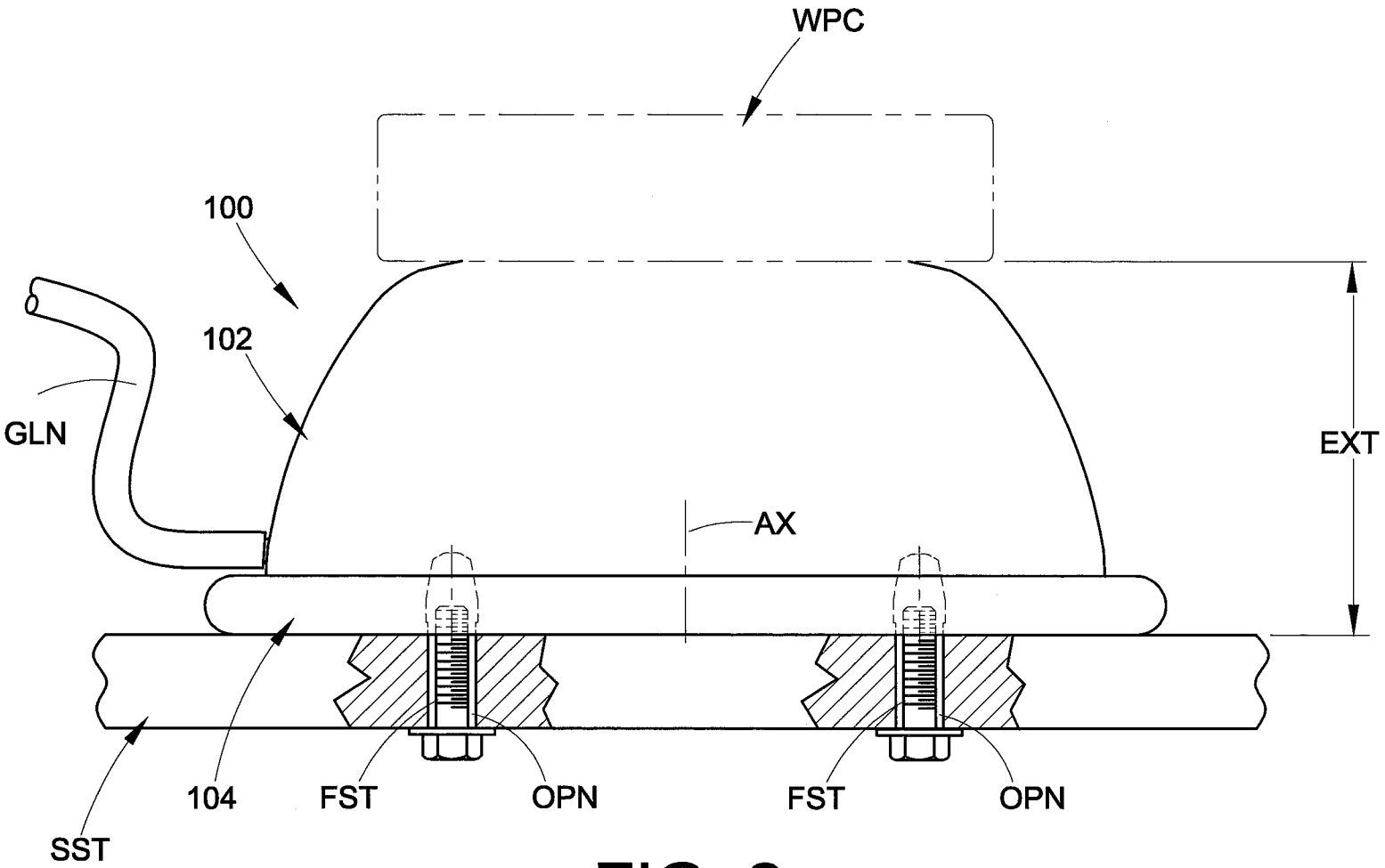
FIG. 2 is a side elevation view of the pneumatic actuator in FIG. 1 shown in an extended condition and supporting the associated work piece.
Figure 3:
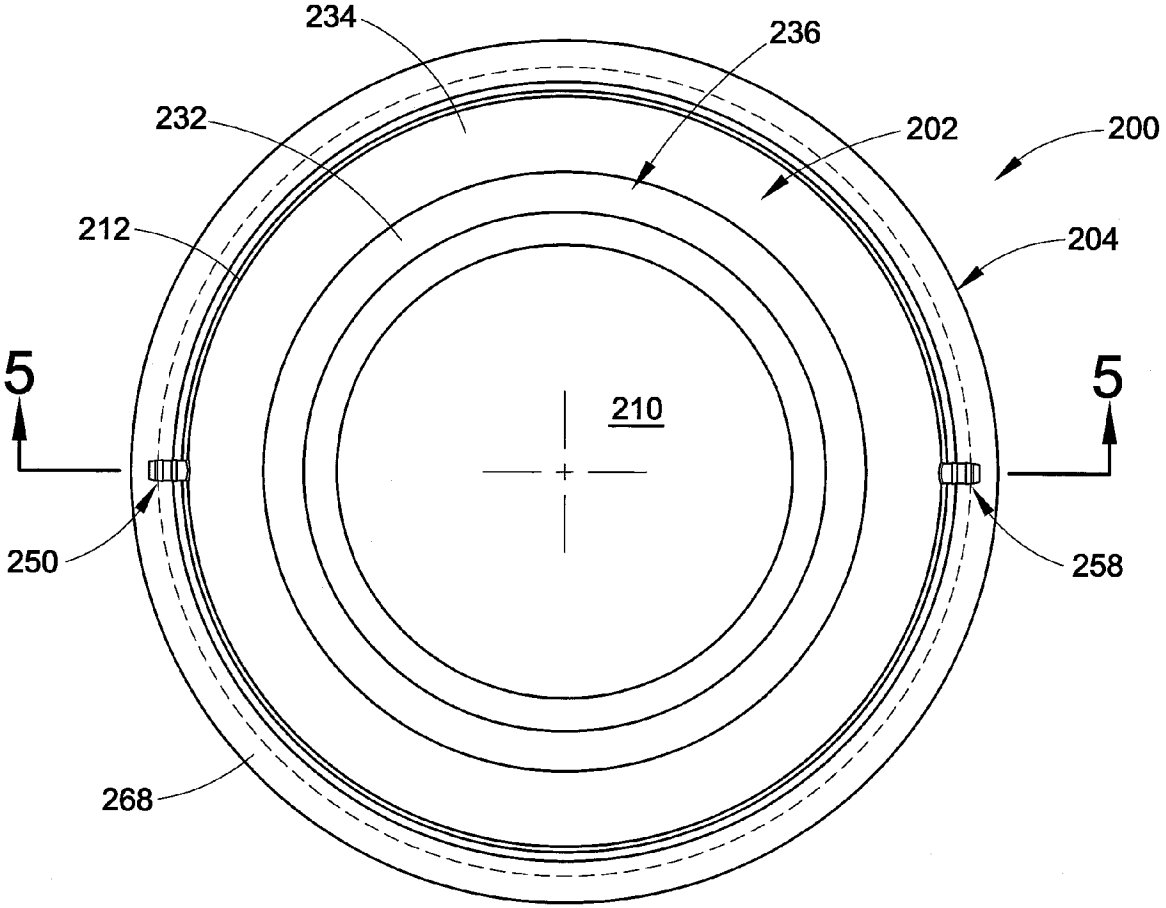
FIG. 3 is a top plan view of another example of a pneumatic actuator in accordance with the subject matter of the present disclosure.

Turning, now, to the drawings, wherein the showings are provided for the purpose of illustrating examples of the subject matter of the present disclosure and which are not to be interpreted as limiting, FIGS. 1 and 2 illustrate one example of an actuator 100 in accordance with the subject matter of the present disclosure. As shown in FIGS. 1 and 2, actuator 100 has a longitudinally-extending axis AX and includes a flex member 102 and a mounting base 104 that are operatively connected with one another such that a substantially fluid-tight seal is formed therebetween. Actuator 100 is shown supported on an associated support structure SST and is shown supporting an associated work piece WPC. It will be appreciated that an actuator in accordance with the subject matter of the present disclosure, such as actuator 100, for example, can be used in a wide variety of applications and environments. As such, the associated support structure and the associated work piece are merely representative of opposing elements, components and/or structures that the actuator can act on, against and/or between. Examples of such elements, components and/or structures can include, without limitation, and article and a structure on which the article is supported, opposing machine components, opposing building structures, and/or opposing vehicle components.

Additionally, it will be appreciated that an actuator in accordance with the subject matter of the present disclosure can displace or moveably support either or both of the opposing elements, components and/or structures (e.g., associated support structure SST and associated work piece WPC) in any suitable manner. For example, one of the opposing components can be stationary or otherwise fixed and the other of the opposing components can be moveable relative to the stationary component. In such case, an actuator in accordance with the subject matter of the present disclosure, such as actuator 100, for example, could be supported in a fixed position on the stationary structure and selectively operated to displace or otherwise moveably support the moveable component or element. Alternately, both of the opposing structures or components could be capable of movement. As such, it is to be understood that the usage arrangement shown and described herein is merely exemplary and that any other usage configuration and/or operation could alternately be employed.

One example of an anticipated usage arrangement is shown in FIGS. 1 and 2 in which associated support structure SST is substantially fixed and actuator 100 is supported on the associated support structure. In some cases, actuator 100 may be freely supported on a supporting element, component and/or structure. In other cases, however, the actuator may be secured to the supporting element, component and/or structure in a suitable manner. In the arrangement shown in FIGS. 1 and 2, for example, actuator 100 is secured to associated support structure SST by way of suitable securement devices, such as fasteners FST, for example, that extend through openings OPN in the associated support structure and operatively engage actuator 100. It will be appreciated that fasteners FST can be of any suitable type, kind and/or configuration, such as elongated threaded fasteners that threadably engage corresponding securement features of the actuator, for example.

Further to the above-described example of an anticipated usage arrangement, actuator 100 can be fluidically connected to an associated pressurized gas source (not shown) in any suitable manner, such as, for example, by way of a pressurized gas line GLN that is operatively connected to an internal chamber of the actuator. By selectively transferring pressurized gas into and out of the internal chamber, the actuator can be displaced between a collapsed condition, which is represented by reference dimension COL in FIG. 1, and an extended condition, which is represented by reference dimension EXT in FIG. 2. In such case, the actuator can generate and apply an associated force capable of selectively positioning or otherwise displacing associated work piece WPC relative to associated support structure SST.

Another example of a pneumatic actuator in accordance with the subject matter of the present disclosure that is suitable for use in association with the aforementioned and/or other usage arrangements is illustrated in and described in connection with FIGS. 3-8 as pneumatic actuator 200. Pneumatic actuator 200 is shown as having a longitudinally-extending axis AX and including a flex member 202 and a mounting base 204, which may be similar to flex member 102 and mounting base 104, respectively, of actuator 100. As discussed above, flex member 202 and mounting base 204 are preferably operatively connected to one another such that a substantially fluid-tight seal is formed therebetween. Additionally, flex member 202 and mounting base 204 at least partially define an actuator chamber 206 within actuator 200 that pressurized gas (e.g., pressurized air) can be selectively transferred into and out of to selectively displace the actuator between the collapsed and extended conditions illustrated in and described in connection with FIGS. 1 and 2.

Flex member 202 includes a flexible wall 208 that is formed from a polymeric material. Flexible wall 208 is identified in FIGS. 3-6 as including a central portion 210 (which may alternately be referred to herein as a central wall) that extends in transverse relation to axis AX and is generally operative to engage an associated element, component or structure, such as work piece WPC, for example. Flexible wall 208 also includes a side portion 212 (which may alternately be referred to herein as a side wall) that extends in a generally axial direction (e.g., in approximate alignment with axis AX). In the exemplary arrangement shown in FIGS. 3-8, central portion 210 at least partially defines a closed end 214 of flex member 202 and side portion 212 at least partially defines an open end 216 of the flex member. It will be appreciated, however, that other configurations could alternately be used.

Flexible wall 208 is shown as including an end surface 218 disposed along open end 216. In the exemplary arrangement shown in FIGS. 3-8, side portion 212 terminates in an axial direction along end surface 218. One or more sealing features can optionally be provided on or along end surface 218. As can be seen in FIG. 8, for example, a plurality of sealing features 220 can project outwardly from end surface 218 in an approximately axial direction. In the exemplary arrangement shown, sealing features 220 extend circumferentially about axis AX along the end surface to form sealing ribs that are annular in configuration. It will be appreciated, however, that other arrangements could alternately be used.

A mounting bead 222 extends radially-outwardly from along side portion 212 and extends peripherally about axis AX. In the exemplary arrangement shown, mounting bead 220 forms an outermost periphery of flex member 202. It will be appreciated, however, that other arrangements and/or configurations could alternately be used. Mounting bead 222 is shown in greater detail in FIGS. 7 and 8 and can include a bead recess surface 224 and a bead projection surface 226. Bead recess surface 224 is spaced axially from end surface 218 such that a minimum recess distance is defined between the bead recess surface and end surface 218, as is represented in FIG. 8 by reference dimension MRD. Bead projection surface 226 is spaced axially from end surface 218 such that a maximum projection distance is defined between the bead projection surface and the end surface, as is represented in FIG. 8 by reference dimension MPD. In a preferred arrangement, minimum recess dimension MRD is less than maximum projection dimension MPD such that a bead recess or groove 228 extends along at least a portion of mounting bead 222. In a preferred arrangement, bead recess 228 is substantially annular in configuration. However, other configurations could alternately be use. Optionally, mounting bead 222 can also include a bead side surface 230 that is disposed radially-outwardly of bead recess surface 224. In the exemplary arrangement shown in FIGS. 3-8, bead side surface 230 is disposed radially-outwardly of at least a portion of bead projection surface 226 and intersects with end surface 218 to define an outer peripheral extent of mounting bead 222.

Flexible wall 208 can also include one or more pleats, convolutions or other features that permit central portion 210 to be displaced in an axial direction away from mounting base 206 as actuator 200 extends toward extended position EXT, such as is shown in FIG. 2, for example. Flexible wall 208 is shown as including a plurality of wall portions, such as, for example, wall portions 232 and 234 that are disposed between central portion 210 and side portion 212 and at least partially define annular convolutions 236 and 238, respectively. In the exemplary arrangement shown, wall portion 232 is operatively connected between central portion 210 and wall portion 234, and forms annular convolution 236 that opens outwardly in an axial direction away from mounting base 204. Wall portion 234 is operatively connected between wall portion 232 and side portion 212, and forms annular convolution 238 that opens inwardly in an axial direction facing mounting base 204 and is interconnected with or otherwise forms a part of actuator chamber 206.

Figure 5:
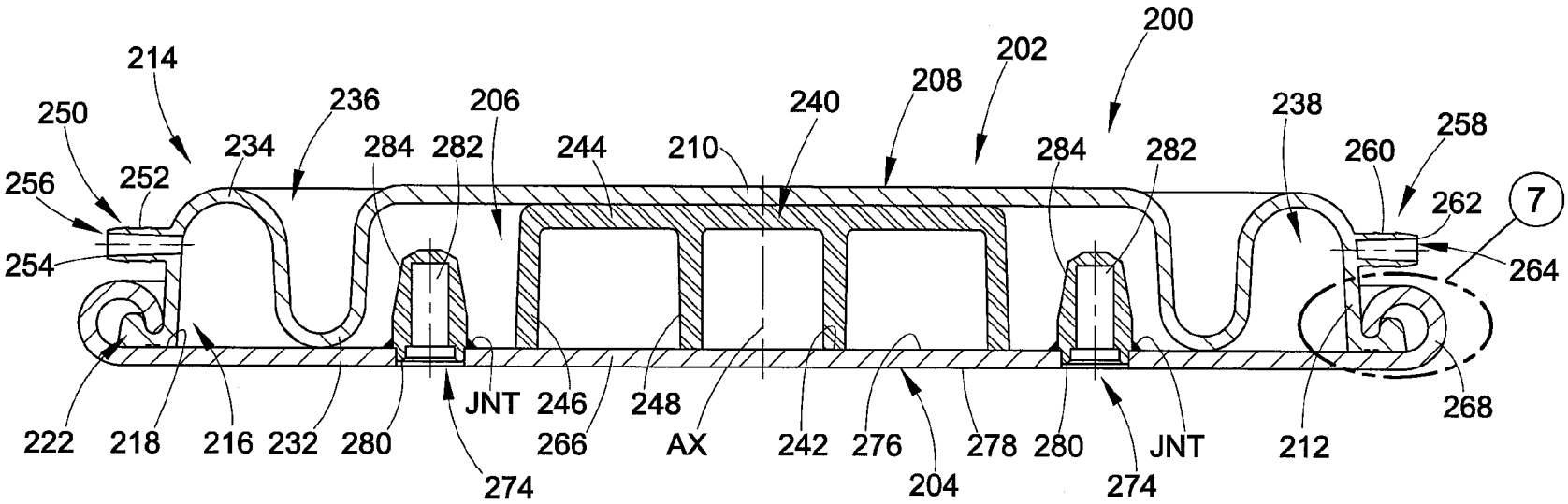
FIG. 5 is a cross-sectional side view of the exemplary pneumatic actuator in FIGS. 3 and 4 taken from along line 5-5 in FIG. 3.
Figure 6:
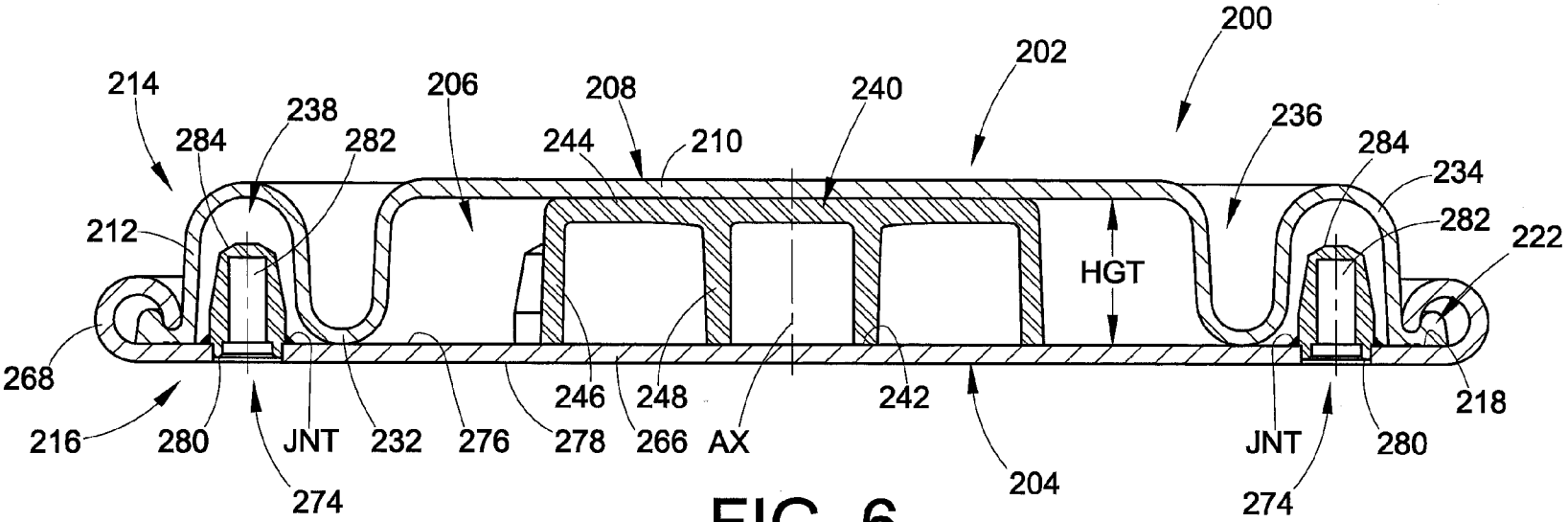
FIG. 6 is a cross-sectional side view of the exemplary pneumatic actuator in FIGS. 3-5 taken from along line 6-6 in FIG. 4.

Actuator 200 can optionally include an internal support structure disposed within actuator chamber 206. The internal support structure can be of any size, shape, configuration, arrangement and/or construction that is suitable for supporting at least a portion of flex member 202 when the actuator is in a collapsed condition. One example of a suitable internal support structure is shown in FIGS. 5 and 6 as an internal support structure 240 that is disposed within actuator chamber 206. In the exemplary arrangement shown, internal support structure 240 includes an end wall 242 that is disposed toward and abuttingly engages mounting base 204, and an opposing end wall 244 that is disposed toward and abuttingly engages central portion 210 of flexible wall 208. End walls 242 and 244 can be supported in spaced relation to one another in any suitable manner. For example, an outer side wall 246 and/or an inner side wall 248 can extend between and thereby support the end walls in spaced relation to one another. Additionally, internal support structure 240 can be secured on or along either flex member 202 or mounting base 204 in a suitable manner, such as by using threaded fasteners (not shown) or a flowed-material joint, for example. In an alternate arrangement, the internal support structure could be integrally formed as a part of flex member 202 and/or mounting base 204. Regardless of the configuration and/or construction of the internal support structure, it will be appreciated that the internal support structure can be of any thickness or height, as is represented by reference dimension HGT in FIG. 6. As one example, internal support structure 240 is shown as having a height that results in at least some of wall portion 232 abuttingly engaging mounting base 204.

An actuator in accordance with the subject matter of the present disclosure can also include one or more connection features dimensioned for operative interconnection with an associated gas transfer line, such as, for example, may be operatively associated with an associated pressurized gas source or other component of an associated pressurized gas system. It will be appreciated that such one or more connection features can be provided in any one or more of a variety of manners. In cases in which two or more connection features are provided, the same can be positioned in any suitable orientation and/or arrangement. For example, the connection features can be symmetrically or asymmetrically positioned around or otherwise on the actuator, and/or can be evenly or unevenly spaced relative to one another around or otherwise on the actuator. In some cases, two adjacent connection features may be spaced circumferentially about an axis of an actuator. In such case, any two adjacent connection features can be positioned at an included angle relative to one another that is within a range of from approximately 15 degrees to approximately 180 degrees.

In the exemplary arrangement shown in FIGS. 3-8, actuator 200 includes a connection feature 250 that is provided along flex member 202. Connection feature 250 is disposed along flexible wall 208 and, as can be more clearly seen in FIG. 5, includes a connector wall 252 that extends from a distal end 254 toward side portion 212. Connector wall 252 at least partially defines a connector passage 256 that extends into the connection feature from along distal end 254. Connector passage 256 extends through flexible wall 208 and into fluid communication with actuation chamber 206 of actuator 200. As such, pressurized gas can be transferred into and out of actuation chamber 206 through connector passage 256.

As discussed above, one feature of an actuator in accordance with the subject matter of the present disclosure can be the inclusion of a plurality of connection features on the actuator. Still another feature of an actuator in accordance with the subject matter of the present disclosure can be that one or more of the plurality of connection features is fluidically isolated from the actuation chamber of the actuator in the initial condition or state of the connection feature or features. It will be appreciated that such an arrangement may permit an actuator in accordance with the subject matter of the present disclosure to be converted from a condition in which the connector passage of a lesser number (e.g., zero or one) of connection features is in fluid communication with the actuation chamber to a condition in which the connector passage of a greater number (e.g., one, two, or more) of connection features are in fluid communication with the actuation chamber. In such case, a plurality of actuators could, for example, be fluidically interconnected in series with one another and/or provide the capability to convert a single passage actuator to a multi-passage actuator. Additionally, where three or more fluid connection features are provided with one connector passage in fluid communication with the actuation chamber and two or more connector passages fluidically isolated from the actuation chamber, the actuator can be selectively configured for use in a particular application.

In the exemplary arrangement shown in FIGS. 3-8, actuator 200 can optionally include a connection feature 258 (FIGS. 3 and 5) that is provided along flex member 202. Connection feature 258 is disposed along flexible wall 208 in approximately polar opposite position with respect to connection feature 250. As can be more clearly seen in FIG. 5, connection feature 258 includes a connector wall 260 that extends from a distal end 262 toward side portion 212. Connector walls 260 at least partially define a connector passage 264 that extends into the connection feature and terminates at flexible wall 208. As such, connector passage 264 is fluidically isolated from actuation chamber 206 in the initial condition of connection feature 258. Connector passage 264 can be placed in fluid communication with actuator chamber 206 in any suitable manner, such as, for example, by forming a hole or opening (e.g., drilling or punching) through flexible wall 208.

The mounting base of an actuator in accordance with the subject matter of the present disclosure is secured across an open end of the flex member to at least partially define the actuator chamber of the actuator. The mounting base can include a base portion (which may alternatively be referred to herein as a base wall) that extends transverse to the axis of the flex member, and a bead portion (which may alternatively be referred to herein as a bead wall) that abuttingly engages the flexible wall and urges at least a portion of the flexible wall into abutting engagement with the base portion to form a substantially fluid-tight seal therebetween.

Figure 7:
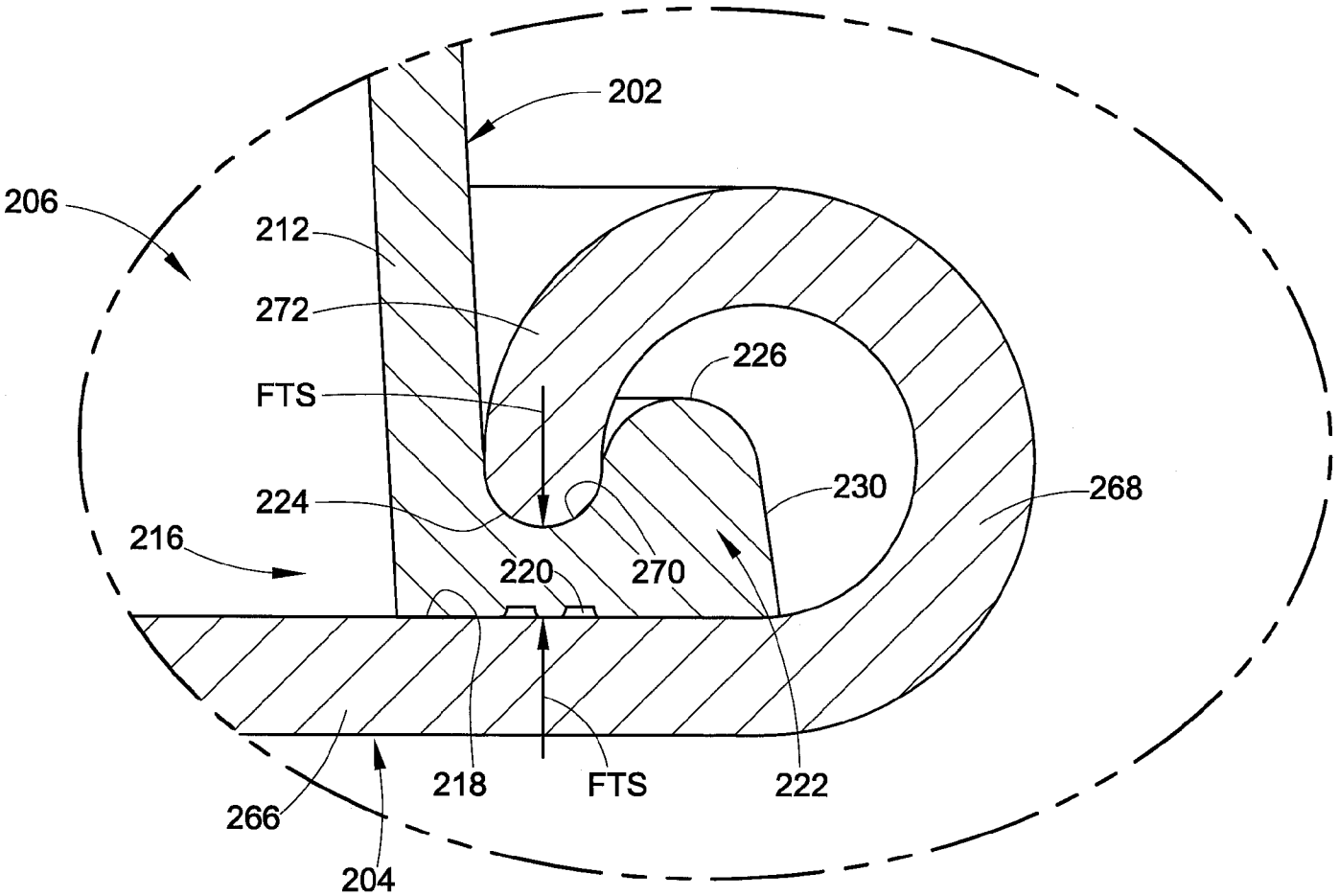
FIG. 7 is an enlarged cross-sectional side view of the section of the exemplary pneumatic actuator in FIGS. 3-6 that is identified in Detail 7 of FIG. 5.
Figure 8:
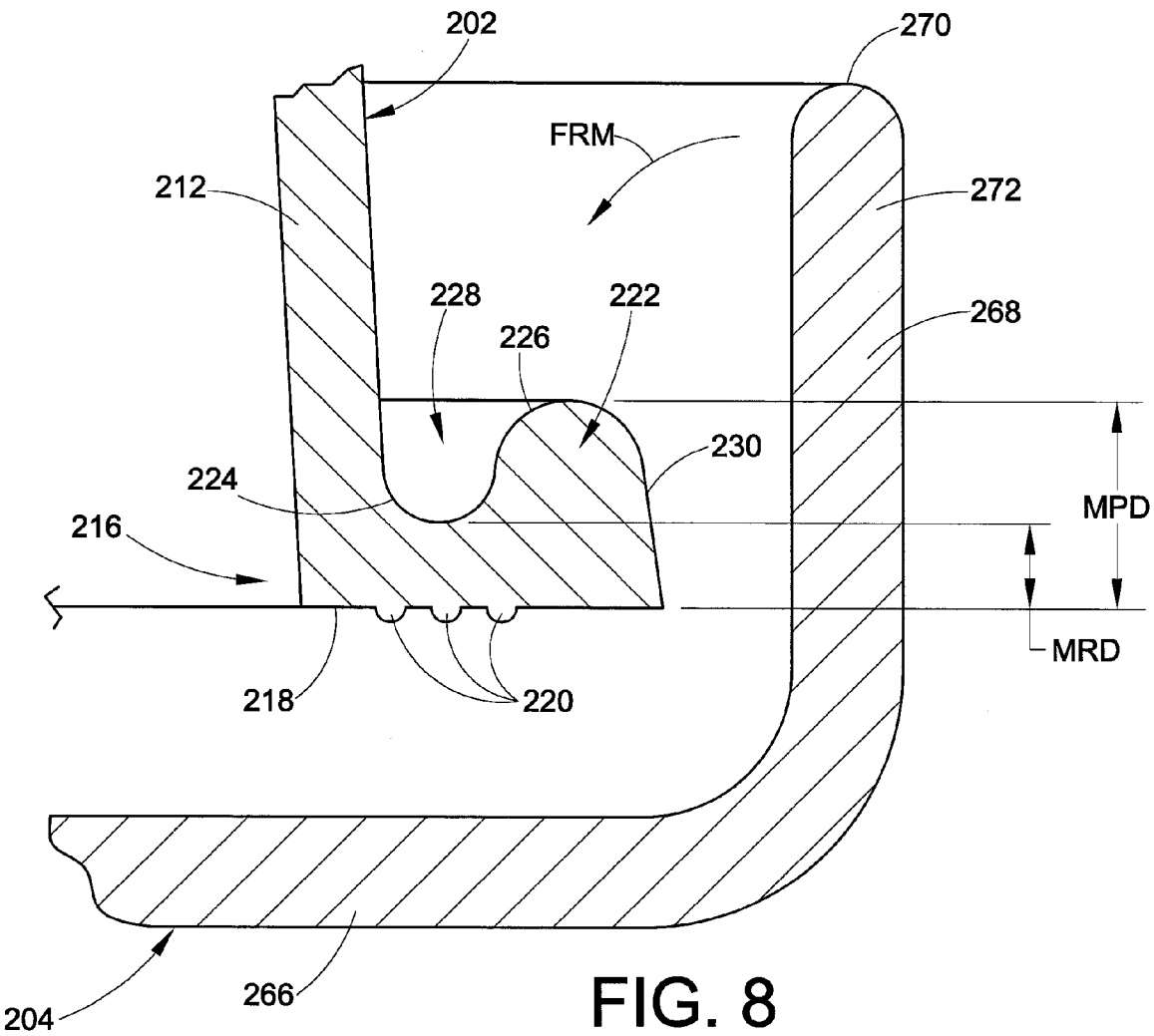
FIG. 8 is a view of the section of the exemplary pneumatic actuator identified in FIG. 7 shown prior to assembly.

In the exemplary arrangement shown in FIGS. 3-8, mounting base 204 is disposed across open end 216 of flexible wall 208 and thereby at least partially defines actuator chamber 206. Mounting base 204 includes a base portion 266 that is disposed in transverse relation to axis AX of flex member 202. Mounting base 204 also includes a bead portion 268 that is received in bead recess 228 and abuttingly engages bead recess surface 224 such that end surface 218 of flexible wall 208 is urged toward and into abutting engagement with base portion 266 of mounting base 204. In this manner, mounting base 204 can form and maintain a substantially fluid-tight seal with flex member 202, as is represented in FIG. 7 by reference arrows FTS. In extending across open end 216 of flex member 202, the mounting base at least partially defines actuator chamber 206.

The base portion and bead portion, such as base portion 266 and bead portion 268 of mounting base 204, for example, can be provided in any suitable manner. As one example, a base portion and a bead portion can be provided as separate elements or components that can be secured together in a suitable manner to form a mounting base (such as will be described hereinafter in connection with FIGS. 20 and 21, for example). As another example, the base portion and the bead portion of the mounting base can be formed from a single, contiguous and/or unitary section of material. While it will be appreciated that any suitable material or combination of materials could be used, mounting base 204 is shown in FIGS. 3-8 as being formed from a sheet of metal material, such as steel or aluminum, for example. In such an example, it will also be appreciated that the bead portion can be formed from the unitary section of material in any suitable manner and through the use of any number of one or more processes and/or operations that are adapted for forming the same.

For example, mounting base 204 is shown in FIG. 8 as being formed into a cup or pan-shaped configuration in which base portion 266 extends in a direction approximately transverse to axis AX (FIGS. 5 and 6) and bead portion 268 extends from base portion 266 in approximate alignment with axis AX and terminates at an end surface 270. While it will be appreciated that end surface 270 can be of any suitable shape, form and/or configuration, end surface 270 is shown in FIGS. 5-8 as having a curved (e.g., semi-circular) cross-sectional shape. In a preferred arrangement, end surface 270 (in whichever shape, form and/or configuration that is provided) is dimensioned for receipt within bead recess 228 and to abuttingly engage at least bead recess surface 224. In this manner, a substantially fluid-tight seal can be formed between flex member 202 and mounting base 204, such as has been described above, for example.

It will be appreciated that end surface 270 can be formed or otherwise displaced into abutting engagement with flex member 202 in any suitable manner and using any one or more processes and/or operations that may be suitable for forming the desired configuration. For example, at least a distal portion 272 (FIGS. 7 and 8) of bead portion 268 adjacent end surface 270 can be deformed (e.g., crimped) in a radially-inwardly rolled manner, such as is represented by arrow FRM in FIG. 8, until end surface 270 is facing in a direction generally toward base portion 266 of base member 204. As indicated above, however, such a forming operation is merely exemplary and any other suitable processes and/or operations could additionally, or alternately, be used.

Figure 4:
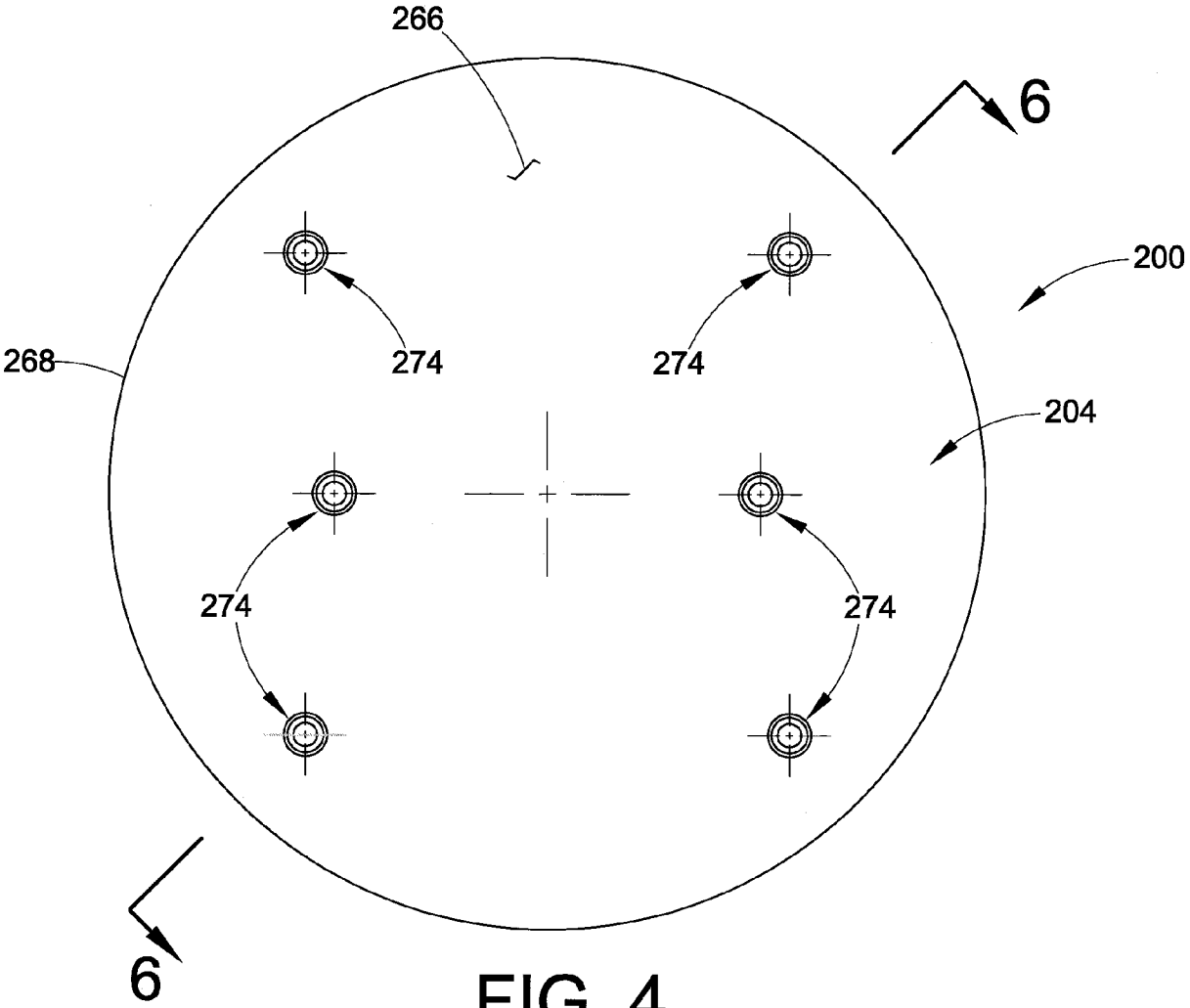
FIG. 4 is a bottom plan view of the exemplary pneumatic actuator in FIG. 3.

Pneumatic actuator 200 can optionally include one or more securement features that may be useful in securing the pneumatic actuator to an associate element, component and/or structure, such as associate support structure SST, for example. As shown in FIGS. 4-6, pneumatic actuator 200 includes a plurality of securement features 274 that are operatively associated with mounting base 204 and suitable for receivingly engaging an associated securement device (not shown) to operatively secure or otherwise attach pneumatic actuator 200 on or along an associate element, component and/or structure, such as associate support structure SST, for example.

Securement features 274 can be operatively associated with mounting base 204 in any suitable manner. For example, base portion 266 can include a surface 276 in communication with actuation chamber 206 and a surface 278 that is opposite surface 276 and at least partially forms an exterior of mounting base 204. Openings 280 extend through base portion 266 and are accessible from along surface 278. Securement) passages 282 are accessible through openings 280 and, in one exemplary embodiment, can include a plurality of threads (not shown) for receiving and threadably engaging associated threaded fasteners, such as fasteners FST in FIGS. 1 and 2, for example. Securement passages 282 can be provided in any suitable manner. In one preferred arrangement, securement passages 282 are fluidically isolated from actuation chamber 206. One example of such an arrangement can include a threaded boss 284, which includes a securement passage 282, being at least partially received within one of) openings 280 and secured to mounting base 204 in a substantially fluid-tight manner such that securement passage 282 is accessible through opening 280 but fluidically isolated from actuator chamber 206. As one example, threaded bosses 284 can be secured to base portion 266 along surface 276 thereof using a flowed-material joint JNT, such as a weld, braze, solder or adhesive joint, for example. As an alternative, one or more threaded studs (not shown) could be secured on or along base portion 266, such as by using a flowed-material joint (not shown), for example. Such one or more threaded studs, of provided, could project outwardly from the base portion in a direction away from flex member 202, for example.

Turning, now, to FIGS. 9-12, one example of a pneumatic actuator and support) pad assembly 300 in accordance with the subject matter of the present disclosure is shown as including a pneumatic actuator 302 and a support pad 304 that abuttingly engages at least a portion of the pneumatic actuator. As is more clearly shown in FIG. 11, pneumatic actuator 302 includes a flex member 306 and a mounting base 308 that are operatively connected with one another such that a substantially fluid-tight seal is formed therebetween. Flex member 306 includes a flexible wall 310 that is formed from polymeric material and includes a central portion 312 that at least partially defines a closed end (not numbered) of the flex member, a side portion 314 that at least partially defines an open end (not numbered) of the flex member, an end surface 316 and a mounting bead 318. Mounting base 308 includes a base portion 320 that is disposed across the open end of flex member 306 and a bead portion 322 that abuttingly engages flex member 306 and thereby captures mounting bead 318 of flexible wall 310 such that the flexible wall is urged toward and into abutting engagement with base portion 320 of mounting base 308.

It will be recognized that pneumatic actuator 302 is shown in FIGS. 9-12 as being substantially similar to pneumatic actuator 200, which is shown and described in detail above in connection with FIGS. 2-8. For brevity, a more detailed description of pneumatic actuator 302 is not provided here. However, it is to be distinctly understood that the foregoing detailed description of pneumatic actuator 200 is equally applicable to pneumatic actuator 302 and that any combination of any one or more of the details and/or characteristics described above with regard to pneumatic actuator 200 can be included as a feature or structure of pneumatic actuator 302. As one example, pneumatic actuator 302 is shown in FIGS. 9-12 as including a connection feature 324 that is provided along flex member 306 and includes a connector wall 326 that extends from a distal end (not shown) toward side portion 314 and defines a connector passage 328 in fluid communication with an actuator chamber 330 of pneumatic actuator 302. As another example, pneumatic actuator 302 could optionally include another connector feature (not shown) that at least partially defines a connector passage that is fluidically isolated from the actuator chamber, such as has been described above in connection with connector feature 258 of pneumatic actuator 200, for example.

Support pad 304 is shown in FIGS. 9-12 as including a support pad wall 332 that can be formed from any suitable material or combination of materials. For example, the support pad wall could be molded or otherwise formed from a polymeric material, such as a rubber (e.g., natural or synthetic rubber), a polyamide material (e.g., nylon), polyolefin-based material (e.g., polyethylene and polypropylene) or polyurethane-based material. In a preferred arrangement, support pad wall 332 is formed from a polymeric material that is sufficiently flexible to be forced outwardly around, and thereby receive, at least a portion of pneumatic actuator 302 while being sufficiently rigid to support the pneumatic actuator under load without substantial axial deformation. One example of such a material is polyurethane having a durometer within a range of approximately 60 Shore A hardness to approximately 70 Shore D hardness.

Support pad wall 332 can be of any suitable shape, configuration and/or arrangement. Additionally, it will be appreciated that support pad wall 332 can be formed in any suitable manner and/or through the use of any one or more manufacturing processes or steps that may be suitable for forming the support pad wall. As one example, the support pad wall could be overmolded over or otherwise along at least a portion of the mounting base (e.g., mounting base 308). Optionally, one or more surface treatments (e.g., surface roughening, applying a sizing agent or primer) can be applied on or along at least a portion of the mounting base. As another example, the support pad wall could be formed from one or more wall portions that are separately or together attached, bonded or otherwise secured to at least a portion of the mounting base (e.g., mounting base 308), such as by using an adhesive material, for example.

Another example is shown in FIGS. 9-12 in which support pad wall 332 includes a base portion 334 and a side portion 336. In the arrangement shown and described in FIGS. 9-12, support pad 304 is shown as being molded or otherwise formed as a single, contiguous and/or unitary construction in which side portion 336 of support pad wall 332 is integrally formed with base portion 334. As shown in greater detail in FIGS. 11 and 12, base portion 334 includes a surface 338 that at least partially forms an exterior of support pad 304 and an opposing surface 340. In the embodiment shown, surfaces 338 and 340 are smooth and approximately planar. It will be appreciated, however, that other configurations could alternately be used. For example, either or both of surfaces 338 and 340 could be non-planar in cross-sectional shape and/or could be textured, such as may be useful for reducing slippage, for example.

Pneumatic actuator 302 can include an axis (FIGS. 1, 2, 5 and 6) such as is shown and described in connection with actuators 100 and 200, for example. Side portion 336 is shown as extending in an approximately axial direction from base portion 334 and terminating at an end surface 342 that extends approximately transverse to axis AX. Side portion 336 also includes a surface 344 (FIG. 12) that at least partially forms an exterior of support pad 304 and a surface 346 (FIG. 12) disposed opposite surface 344. Surfaces 342-346 can be smooth or, alternately, one or more of the surfaces can be textured. As indicated above, surfaces 338, 342 and 344 can at least partially form an exterior of support pad 304. Additionally, surfaces 340 and 346 can at least partially form a support pad cavity 348 (FIG. 12) that is dimensioned to receive and retain at least a portion of pneumatic actuator 302.

Figure 11:
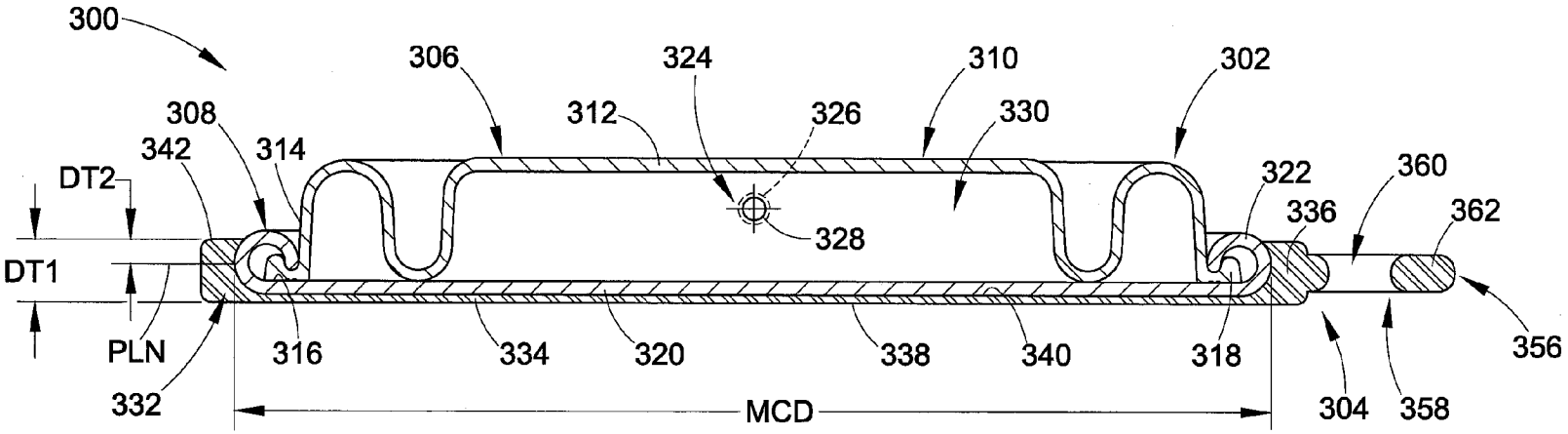
FIG. 11 is a cross-sectional side view of the exemplary pneumatic actuator and support pad assembly in FIGS. 9 and 10 taken from along line 11-11 in FIG. 10.

Support pad wall 332 and support pad cavity 348 can be configured in any suitable manner to receive and retain at least a portion of the pneumatic actuator. For example, bead portion 322 of mounting base 308 can include a plane PLN along or through which the maximum cross-sectional dimension (e.g., outside diameter) of the bead portion extends, such as is represented by reference dimension MCD (FIG. 11), for example. Side portion 336 of support pad wall 332 can extend in an approximately axial direction from base portion 334 a distance sufficient to abuttingly engage an area of bead portion 322 that is disposed on an opposing side of plane PLN from base portion 320. In this matter, support pad wall 332 can function to retain pneumatic actuator 302 within support pad cavity 348. As one example of such a configuration, end surface 342 of side portion 336 can be disposed a distance from surface 338 of base portion 334, as is represented in FIG. 11 by reference dimension DT1, that is sufficient for surface 338 to be disposed a distance from plane PLN, as is represented in FIG. 11 by reference dimension DT2, when pneumatic actuator 302 is at least partially received in support pad cavity 348.

Figure 12:
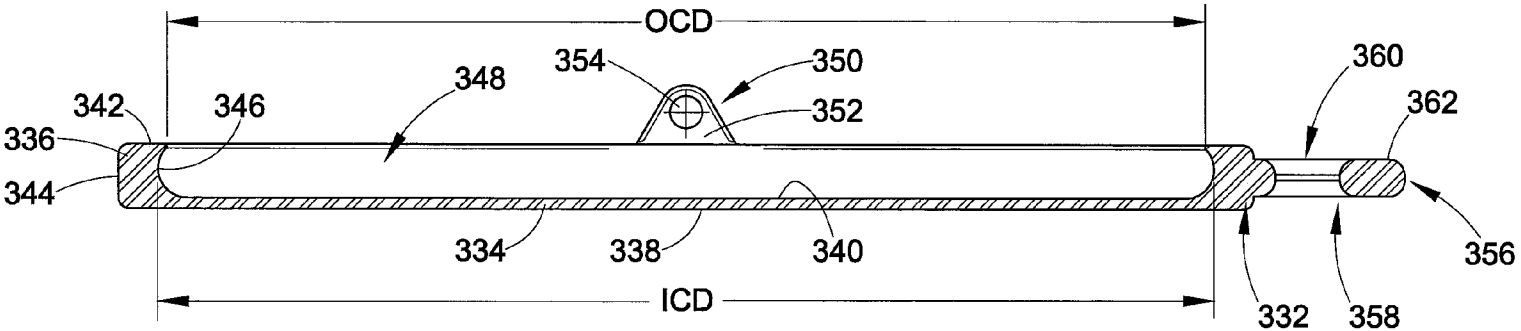
FIG. 12 is a cross-sectional side view of the exemplary support pad in FIG. 11 shown without the exemplary pneumatic actuator.
Figure 13:
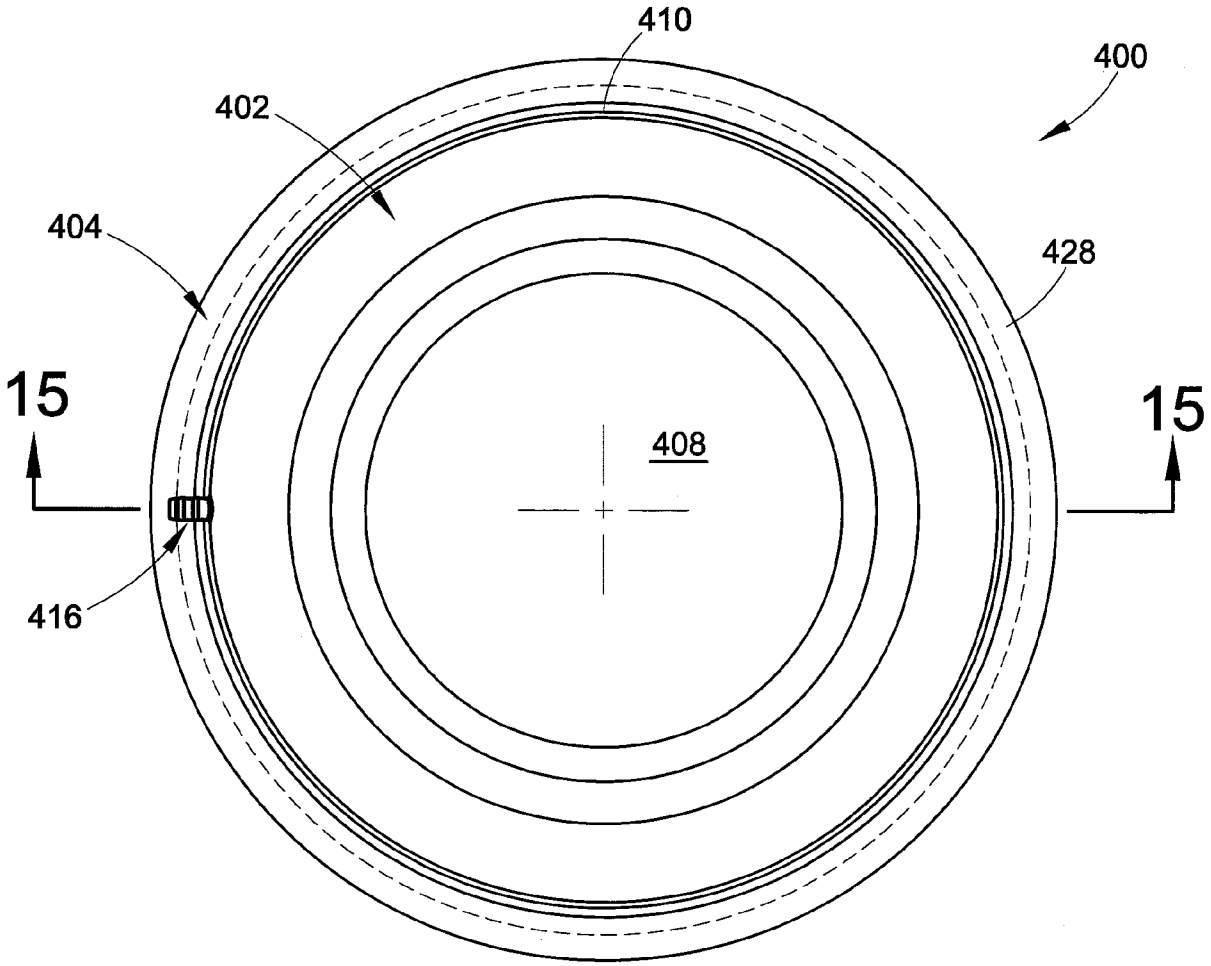
FIG. 13 is a top plan view of another example of a pneumatic actuator in accordance with the subject matter of the present disclosure.

It will be appreciated that base portion 334 and side portion 336 of support pad wall 332 can be of any suitable size, shape, form and/or configuration for receiving at least a portion of pneumatic actuator 302 within support pad cavity 348 and retaining the pneumatic actuator within the support pad cavity. For example, surface 340 of base portion 334 is shown as being approximately planar and surface 346 of side portion 336 is shown as having a curved profile extending between surface 342 of side portion 336 and surface 340 of base portion 334. Side portion 336 can have an inner cross-sectional dimension, such as may be defined by surface 346, for example, that at least partially defines the size and/or shape of support pad cavity 348, such as is represented in FIG. 12 by reference dimension ICD, for example. Additionally, side portion 336 can at least partially define an open end of support pad cavity 348 that has an opening cross-sectional dimension, such as is represented in FIG. 12 by reference dimension OCD, for example.

It will be appreciated that maximum cross-sectional dimension MCD of mounting base 308 can be of any suitable dimension, such as within a range of approximately ½ inch to approximately 60 inches, for example. In some cases, it may be desirable for mounting base 308 to be at least partially received in support pad cavity 348 and abuttingly engaged by side portion 336 such that little or no clearance exists between the exterior periphery of the mounting base and surface 346 of the side portion of the support pad wall. It will be appreciated that such an arrangement can be achieved in any suitable manner. For example, inner cross-sectional dimension ICD of support pad cavity 348 can be approximately the same as or slightly smaller in dimension that the maximum cross-sectional dimension of the mounting base, such as, for example, by inner cross-sectional dimension ICD being within a range of from approximately 90% to approximately 105% of the maximum cross-sectional dimension of mounting base 308. In a preferred arrangement, inner cross-sectional dimension ICD can be within a range from approximately 95% to approximately 100% of maximum cross-sectional dimension MCD of the mounting base.

Support pad 304 can also optionally include one or more tube support portions 350 that extend from along support pad wall 332 and are dimensioned to receivingly engage an associated pressurized gas line GLN, such as may be suitable for transferring pressurized gas into and out of actuator chamber 330 through connector passage 328 of connection feature 324, for example. Tube support portion 350 is shown in FIGS. 9-12 as including a tube support wall 352 that projects from along support pad wall 332 with an opening 354 extending therethrough that is dimensioned to receivingly engage the associated pressurized gas line. It will be appreciated that tube support wall 352 can extend from the support pad wall in any suitable manner, configuration and/or arrangement. In the exemplary arrangement in FIGS. 9-12, tube support portion 350 projects in approximate alignment with axis AX (FIGS. 5 and 6) from along support pad wall 332 in a direction extending away from base portion 334 of the support pad wall. Additionally, opening 354 extends through the tube support wall in transverse relation to the axis, and is shown as being disposed axially outwardly beyond surface 342 of side portion 336. If two or more tube support portions are included, it will be appreciated that the two or more tube support portions can be disposed on, along or otherwise about support pad wall 332 in any suitable pattern, configuration and/or arrangement, such as has been described above in connection with connection features 250 and 258 of pneumatic actuator 200, for example.

Figure 9:
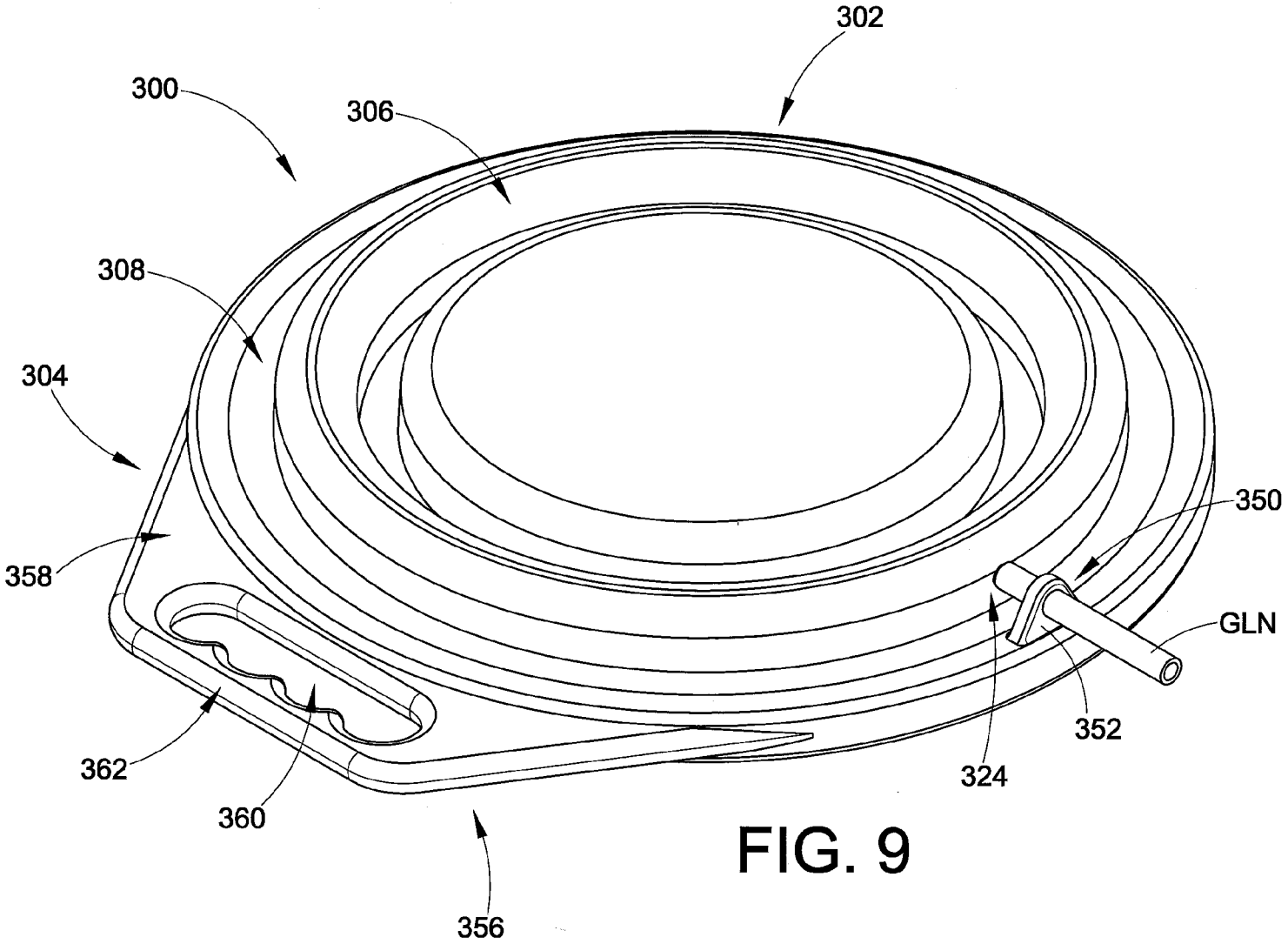
FIG. 9 is a perspective view of one example of a pneumatic actuator and support pad assembly in accordance with the subject matter of the present disclosure.
Figure 10:
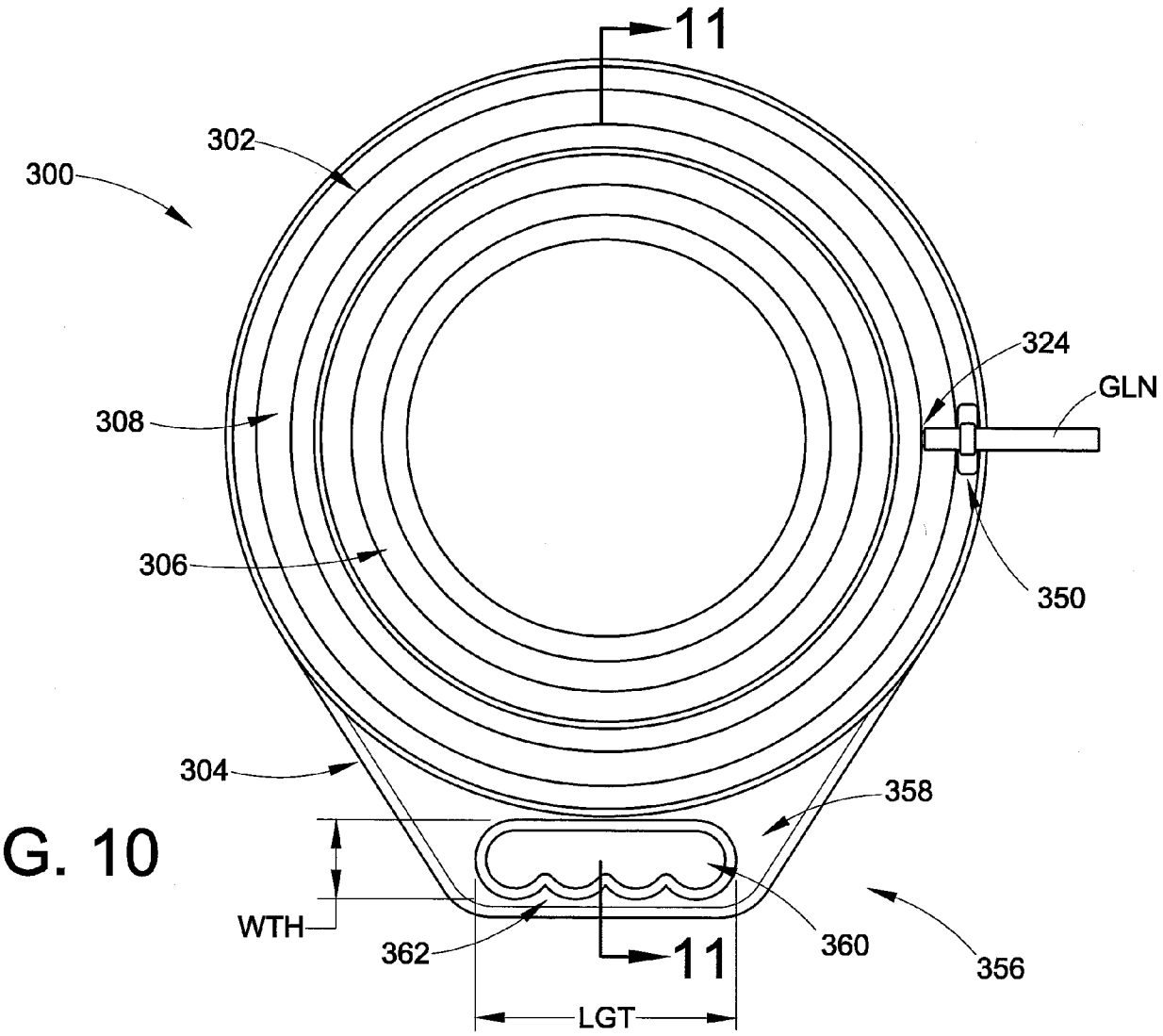
FIG. 10 is a top plan view of the exemplary pneumatic actuator and support pad assembly in FIG. 9.

Support pad 304 can also, optionally, include one or more tab portions that project outwardly from the support pad wall and include one or more openings for handling and/or securing the support pad and, thereby, the pneumatic actuator to an associate support structure, such as associated support structure SST (FIGS. 1 and 2), for example. In the exemplary arrangement shown in FIGS. 9-12, support pad 304 includes a tab portion 356 that projects in a radially-outward direction from along support pad wall 332. Tab portion 356 includes a tab wall 358 that extends from the support pad wall, such as from along surface 344 of side portion 336, for example. Tab wall 358 includes an opening 360 that extends therethrough. It will be appreciated that opening 360 can be of any suitable size, shape and/or configuration. For example, as shown in FIGS. 9 and 10, opening 360 has a width, which is represented in FIG. 10 by reference dimension WTH, and a length, which is represented in FIG. 10 by reference dimension LGT, that is greater than the width such that a handle portion 362 of tab wall 358 is at least partially formed by opening 360. Handle portion 362 may be dimensioned for grasping and handling of pneumatic actuator and support pad assembly 300 by an associated user.

Figure 14:
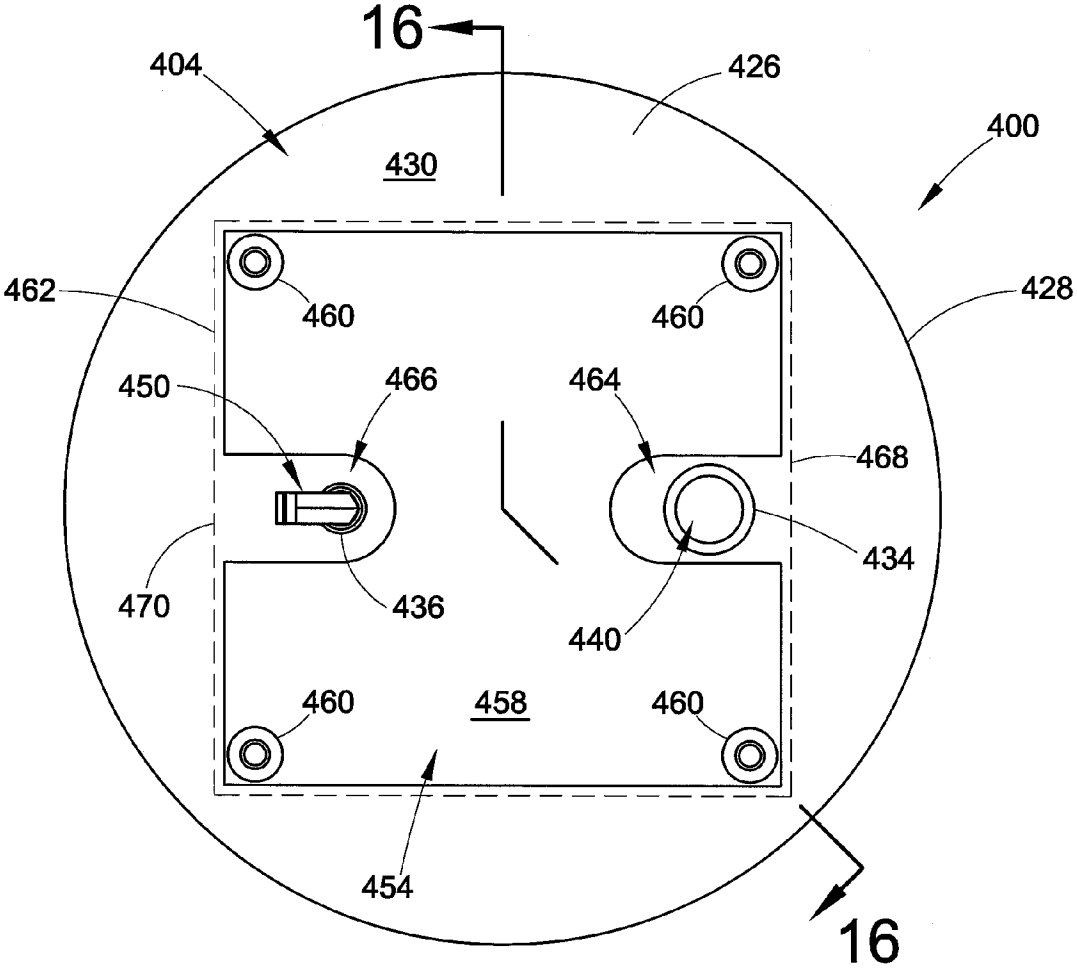
FIG. 14 is a bottom plan view of the exemplary pneumatic actuator in FIG. 13.
Figure 15:
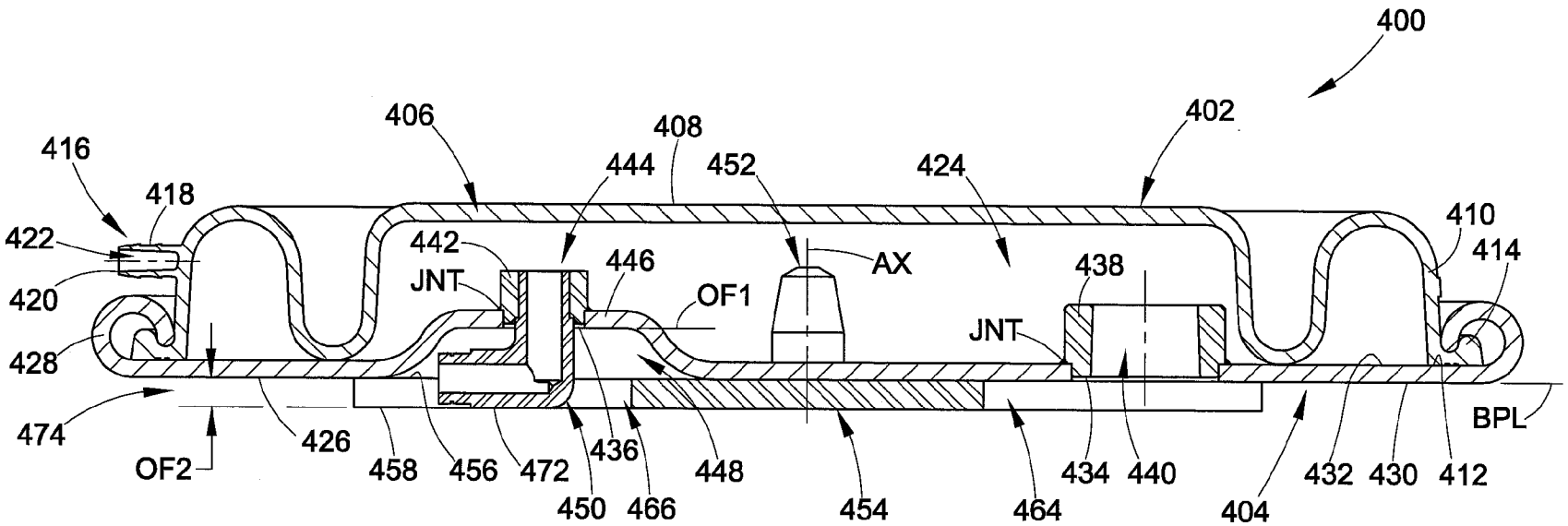
FIG. 15 is a cross-sectional side view of the exemplary pneumatic actuator in FIGS. 13 and 14 taken from along line 15-15 in FIG. 13.

Another example of a pneumatic actuator in accordance with the subject matter of the present disclosure that is suitable for use in association with the foregoing and/or other usage arrangements is illustrated in and described in connection with FIGS. 13-16 as pneumatic actuator 400. Pneumatic actuator 400 is shown as having a longitudinally-extending axis AX and including a flex member 402 and a mounting base 404. Flex member 402 includes a flexible wall 406 that is formed from polymeric material and includes a central portion 408 that at least partially defines a closed end (not numbered) of the flex member. A side portion 410 is disposed radially outwardly of the central portion and at least partially defines an open end (not numbered) of the flex member. Flexible wall 406 also includes an end surface 412 and a mounting bead 414. It will be recognized that flex member 402 is substantially similar to flex members 102, 202 and 306, which have been described above in detail. As such, a more detailed description of flex member 402 is not provided here for purposes of brevity. However, it is to be distinctly understood that the foregoing descriptions of flex members 102, 202 and 306 are equally applicable to flex member 402 and that any combination of any one or more of the details and/or characteristics described above with regard to flex members 102, 202 and 306 can be included as a feature or structure of flex member 402. For example, pneumatic actuator 400 is shown in FIGS. 13-16 as including a connection feature 416 that is provided along flex member 402 and includes a connector wall 418 that extends from a distal end 420 (FIG. 15) toward side portion 410 and at least partially defines a connector passage 422. In some cases, connector passage 422 may be in fluid communication with an actuator chamber 424 formed between flex member 402 and mounting base 404. In other cases, connector passage 422 can be fluidically isolated from the actuator chamber, such as is shown in FIG. 15, for example.

Mounting base 404 includes a base portion 426 and a bead portion 428, and is secured to flex member 402 such that a substantially fluid-tight seal is formed therebetween. It will be appreciated that the interengagement between portions of the mounting base and portions of the flex member have been described in detail above, such as in connection with pneumatic actuator 200, for example. For brevity, a detailed discussion of such features and interengagements is not repeated here. However, it is to be understood that the foregoing description of the features and the interengaging construction as well as the forming of a substantially fluid-tight seal between the flex member and mounting base are equally applicable to the interconnection of flex member 402 and mounting base 404.

Bead portion 428 can include similar features to those described above in connection with other embodiments and can be formed into abutting engagement with flex member 402 in the same or a similar manner as those described above. Base portion 426 includes a surface 430 that at least partially forms an exterior of mounting base 404 and a surface 432 opposite surface 430 that is in fluid communication with actuator chamber 424. Mounting base 404 differs from other embodiments in that base portion 426 can optionally include one or more passages formed therethrough and in fluid communication with the actuator chamber. In the embodiment in FIGS. 13-16, base portion 426 is shown as including openings 434 (FIG. 15) and 436 (FIG. 15). A connection boss 438, which includes a passage 440 in fluid communication with opening 434, can be at least partially received within opening 434 and can be secured to mounting base 404 in a manner suitable for forming a substantially fluid-tight seal therebetween, such as through the use of a flowed-material joint JNT, for example. Similarly, a connection boss 442, which includes a passage 444 in fluid communication with opening 436, can be at least partially received within opening 436 and can be secured to mounting base 404 in a manner suitable for forming a substantially fluid-tight seal therebetween, such as through the use of a flowed-material joint JNT, for example.

Additionally, base portion 426 can at least partially define a base plane BPL (FIG. 15) and can optionally include one or more sections or areas that are disposed out of base plane BPL in an axial direction, such as a direction toward or away from central portion 408 of flexible wall 406, for example. In the exemplary embodiment shown in FIGS. 13-16, base portion 426 includes an area, which is generally identified by item number 446, that is offset from base plane BPL in a direction toward central portion 408 of flexible wall 406, as is indicated by reference line OF1, such that a recess 448 is formed along the exterior of mounting base 404. Offset area 446 includes opening 436 and connection boss 442 is secured to base portion 426 along the offset area. One benefit of providing an area that is offset from base plane BPL, such as offset area 446, for example, is that internal or external recesses, such as recess 448, for example, can be formed thereby, such as may be useful for receiving an additional component, for example. In the exemplary arrangement shown in FIGS. 14 and 15, a connector fitting 450 is operatively connected to connector boss 442 and in fluid communication with passage 444. Connector fitting 450 is accessible from along the exterior of pneumatic actuator 400 and is at least partially received within recess 448.

Figure 16:
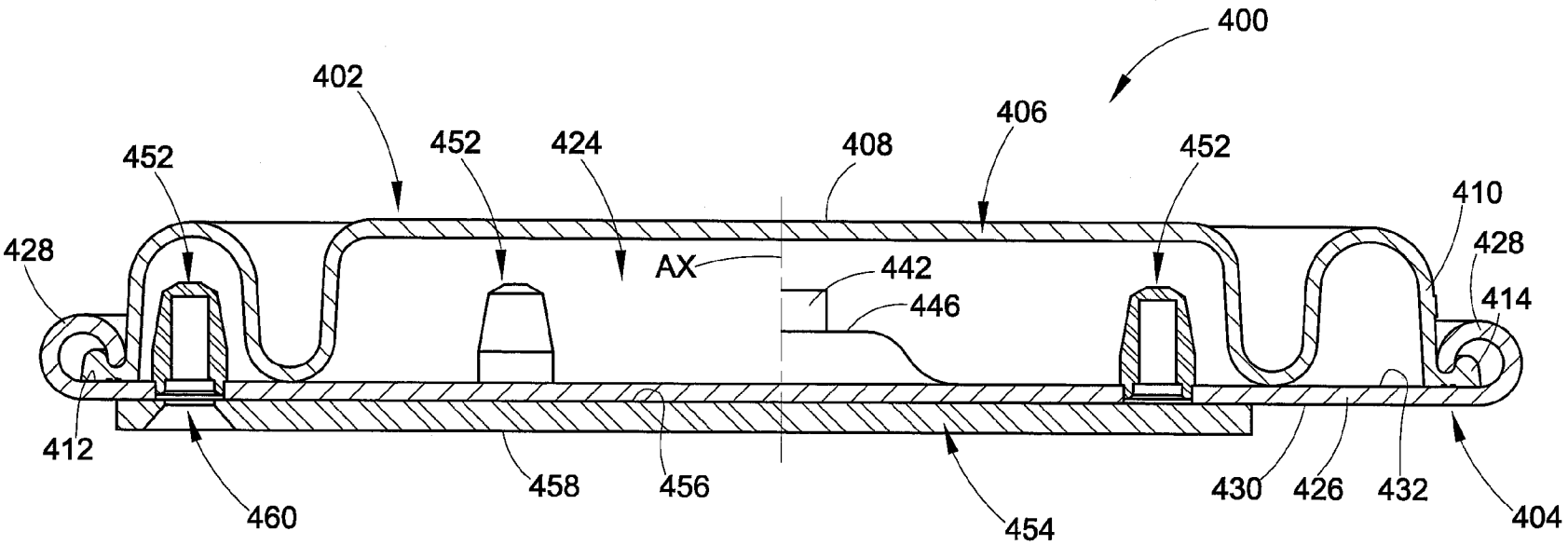
FIG. 16 is a cross-sectional side view of the exemplary pneumatic actuator in FIGS. 13-15 taken from along line 16-16 in FIG. 14.

Pneumatic actuator 400 can optionally include one or more securement features that may be useful in securing the pneumatic actuator to an associated element, component and/or structure, such as associated support structure SST (FIGS. 1 and 2), for example, as has been described above in connection with pneumatic actuators 100 and 200. As shown in FIGS. 14-16, pneumatic actuator 400 can include a plurality of securement features 452 that are operatively associated with mounting base 404 and suitable for receivingly engaging an associated securement device (not shown), such as fasteners FST (FIGS. 1 and 2), for example, to operatively secure or otherwise attach pneumatic actuator 400 and an associated element, component and/or structure to one another. Securement features 452 can be operatively connected on or along mounting base 404 in any suitable manner, such as has been described in detail above in connection with securement features 274 of pneumatic actuator 200, for example.

Additionally, pneumatic actuator 400 can optionally include a support plate 454 that can be operatively connected with mounting base 404 in a suitable manner. As one example, the support plate could be overmolded over or otherwise along at least a portion of the mounting base (e.g., mounting base 404). Optionally, one or more surface treatments (e.g., surface roughening, applying a sizing agent or primer) could be applied on or along at least a portion of the mounting base. As another example, the support plate could be formed from one or more wall portions that are separately or together attached, bonded or otherwise secured to at least a portion of the mounting base (e.g., mounting base 308), such as by using an adhesive material, for example. As a further example, support plate 454 can include opposing sides 456 and 458 with one or more holes extending therethrough. In the exemplary arrangement shown in FIGS. 15-16, support plate 454 includes a plurality of openings or holes 460 that are shown as being disposed in approximate alignment with a corresponding one of securement features 452. As such, side 456 of support plate 454 can be secured in abutting engagement on or along surface 430 of mounting base 404, such as, for example, by extending suitable securement devices (e.g., threaded fasteners FST in FIGS. 1 and 2) through openings 406 and operatively engaging securement features 452. In this manner, support plate 454 can be secured on or along base portion 426 of mounting base 404, such as to buttress or otherwise reinforce the mounting base or for other purposes.

Support plate 454 can also optionally include one or more access features that are included on or along the support plate and permit access to one or more features, elements and/or components of mounting base 404, such as features by which the support plate is operatively connected on or along the mounting base. It will be appreciated that a support plate, such as support plate 454, for example, will generally include an outer peripheral shape, such as is represented in FIG. 14 by dashed line 462, for example. Additionally, it will be appreciated that the one or more access features of the support plate, if provided, can be of any suitable size, shape, configuration and/or arrangement, and can be formed on or along the support plate in any suitable manner. Typically, the one or more access features are at least partially defined by the absence of material that would otherwise be present inside or otherwise along the outer peripheral shape (e.g., outer peripheral shape 462) of the support plate. Additionally, the one or more access features can be formed or otherwise provided by removing material from or deforming a portion of the material of the support plate in a suitable manner. In the exemplary arrangement shown in FIGS. 13-16, support plate 454 is shown as including a plurality of access features 464 and 466 that extend into the support plate from along outer periphery 462 such that passages 440 and 444 are respectively accessible. Access features 464 and 466 are shown as being positioned along opposing edges 468 and 470 (FIG. 14), respectively, of the support plate and are shown as having an elongated slot-like shape that extends inwardly from along outer periphery 462 such that support plate 454 has a somewhat H-shaped configuration.

Another benefit of using a support plate, such as support plate 454, for example, is that the same can provide an additional measure of protection for components that may be secured to the mounting base of the pneumatic actuator. For example, connector fitting 450 is shown in FIG. 15 as projecting axially outwardly beyond surface 430 of mounting base 404. Support plate 454 is disposed along mounting base 404 and positioned such that connector fitting 450 is disposed within access feature 466. It will be recognized that side 458 of support plate 454 is disposed in approximate alignment with a distal portion 472 of connector fitting 450. Thus, the support plate can act as a guard or otherwise at least protect connector fitting 450.

A further benefit of using a support plate, such as support plate 454, for example, is that the same can provide an offset mounting arrangement for the pneumatic actuator along which the support plate is secured. For example, in the arrangement shown in FIGS. 13-16, pneumatic actuator 400 would be supported on or along an associated support structure such that mounting base 404 is disposed in spaced relation to the associated support structure (e.g., associated support structure SST in FIGS. 1 and 2). Such an offset mounting arrangement is represented in FIG. 15 by reference dimension OF2. One benefit of such an offset mounting arrangement is that access can be provided to a corresponding feature or component, such as connector fitting 450, for example, whereby another component, such as a pressurized gas line (not shown), for example, can extend through an offset opening 474 for connection with connector fitting 450.

Figure 17:
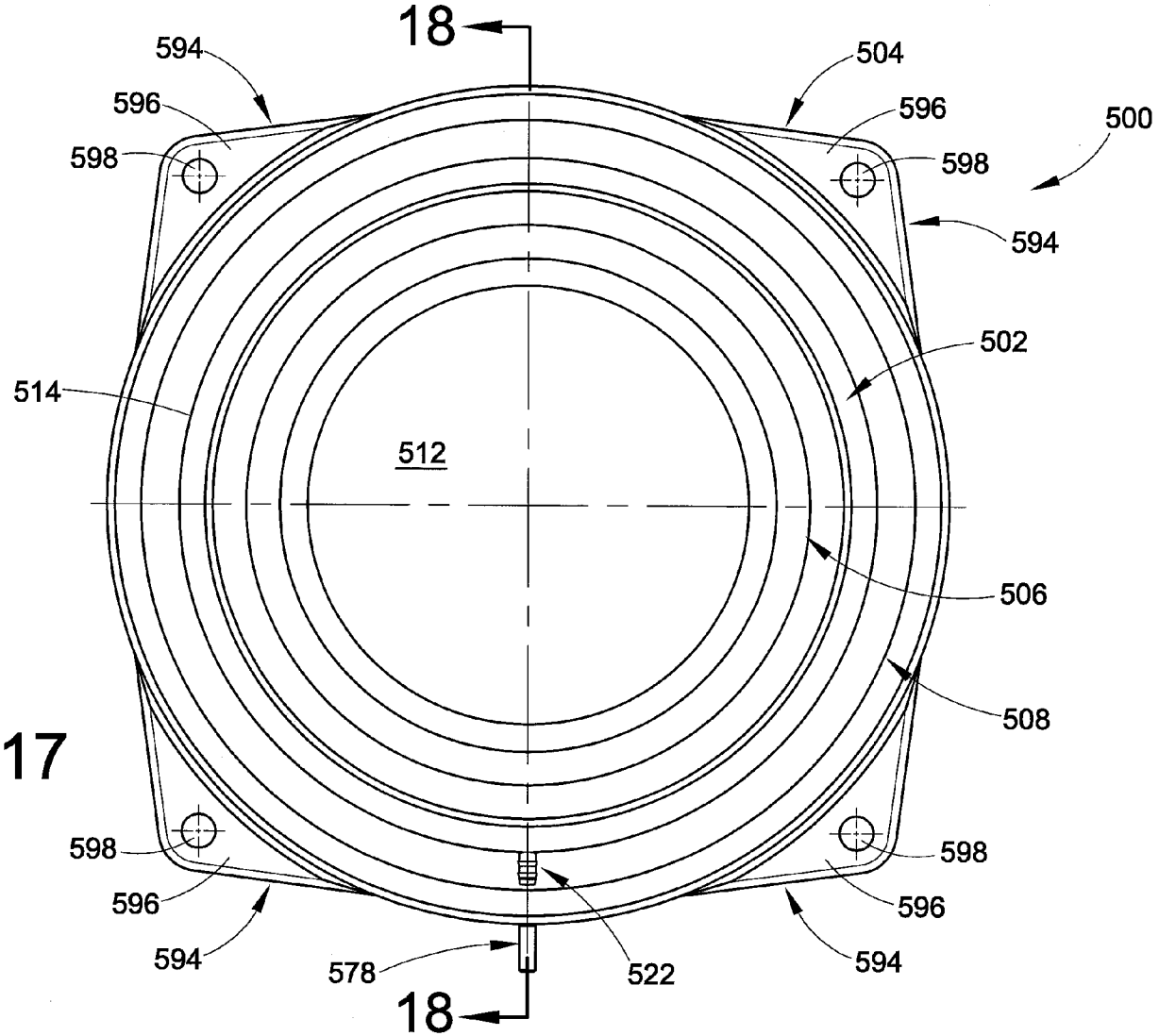
FIG. 17 is a top plan view of another example of a pneumatic actuator and support pad assembly in accordance with the subject matter of the present disclosure.
Figure 18:
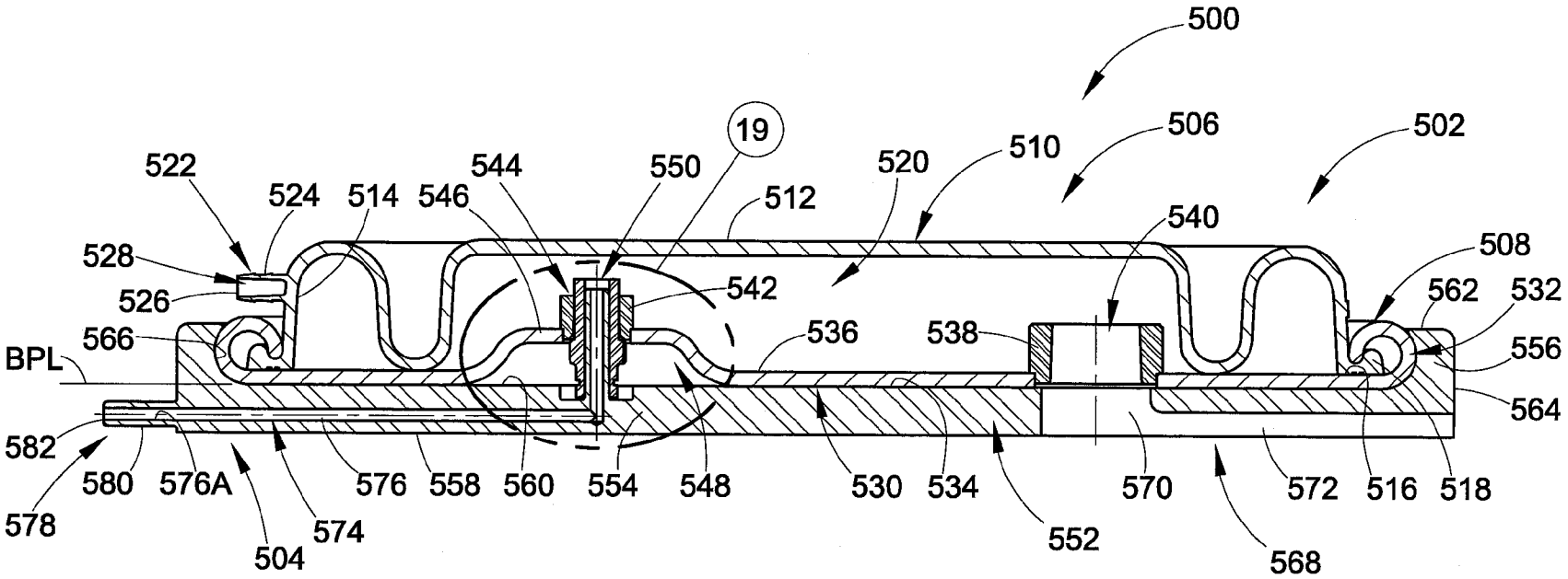
FIG. 18 is a cross-sectional side view of the exemplary pneumatic actuator and support pad assembly in FIG. 17 taken from along line 18-18 in FIG. 17.
Figure 19:
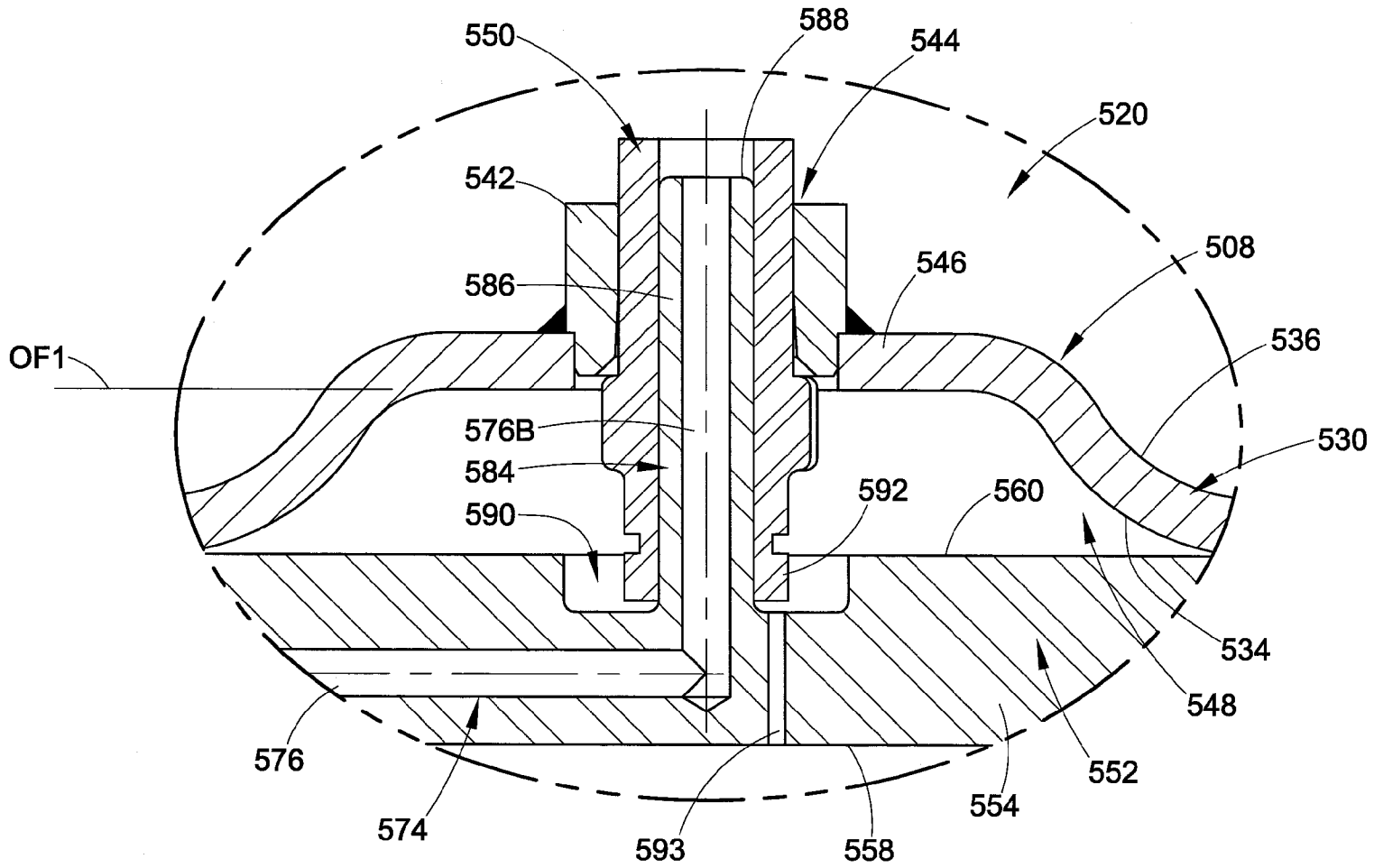
FIG. 19 is an enlarged cross-sectional side view of the section of the exemplary pneumatic actuator and support pad assembly in FIGS. 17 and 18 that is identified in detail 19 of FIG. 18.

Another example of a pneumatic actuator and support pad assembly 500 in accordance with the subject matter of the present disclosure is shown in FIGS. 17-19 as including a pneumatic actuator 502 and a support pad 504 that receives and abuttingly engages at least a portion of pneumatic actuator 502. It will be recognized and appreciated that pneumatic actuator 502 is substantially similar in construction, configuration and operation to pneumatic actuator 400 shown and described in connection with FIGS. 13-16 and is similar in overall construction, configuration and operation to pneumatic actuators 100, 200 and 302, all of which have been described above in detail. As such, while certain features and/or characteristics of pneumatic actuator 502 may not be repeated here in the interest of brevity, it is to be distinctly understood that any one or more details of the foregoing descriptions of pneumatic actuators 100, 200, 302 and 400 may be equally applied to pneumatic actuator 502 and that any combination of any one or more of the details described above with regard to pneumatic actuators 100, 200, 302 and 400 can be included as a feature and/or characteristic of pneumatic actuator 502.

Additionally, it will be recognized and appreciated that support pad 504 is shown as being similar in overall construction, configuration and operation to support pad 304 of pneumatic actuator and support pad assembly 300, which has been described above in detail. While certain features and/or characteristics of support pad 504 may not be repeated here in the interest of brevity, it is distinctly understood that any one or more details of the foregoing description of support pad 304 may be equally applied to support pad 504 and that any combination of any one or more of such details can be included as a feature, structure and/or characteristic of support pad 504.

As is more clearly shown in FIG. 18, pneumatic actuator 502 includes a flex member 506 and a mounting base 508 that are operatively connected to one another such that a substantially fluid-tight seal is formed therebetween. Flex member 506 includes a flexible wall 510 that is formed from a polymeric material and includes a central portion 512 that at least partially defines a closed end (not numbered) of the flex member. The flexible wall also includes a side portion 514 that at least partially defines an open end (not numbered) of the flex member. Flexible wall 510 further includes an end surface 516 and a mounting bead 518. Flex member 506 can include one or more connection features that can be in fluid communication or fluid isolation with an actuator chamber 520, such as have been described above in connection with connection features to 250, 258, 324 and 416, for example. In the exemplary arrangement shown in FIGS. 17 and 18, a connection feature 522 is shown as including a connector wall 524 that extends from a distal end 526 toward side portion 514 such that a connector passage 528, which is shown in fluid isolation from actuator chamber 520, is at least partially defined by the connector wall. In one case, flex member 506 may be substantially identical to flex member 402 of pneumatic actuator 400, which has been described above in connection with FIGS. 13-16. It will be appreciated, however, that other arrangements could alternately be used.

Mounting base 508 includes a base portion 530 and a bead portion 532, and is secured to flex member 506 such that a substantially fluid-tight seal is formed therebetween. It will be appreciated that the interengagement between portions of the mounting base and portions of the flex member have been described above in detail such as in connection with pneumatic actuators 200 and 400, for example. In the interest of brevity, a detailed discussion of such features and interengagements is not repeated here. However, it is to be understood that the previous descriptions of the features and the interengaging constructions as well as the forming of a substantially fluid-tight seal between the flex member and mounting base are equally applicable to the interconnection of flex member 506 and mounting base 508.

Bead portion 532 can include the same or similar features to those described above in connection with other embodiments and, as previously indicated, can be formed into abutting engagement with flex member 506 in the same or a similar manner as those described above. For example, base portion 530 can include a surface 534 that at least partially forms an exterior of mounting base 508 and a surface 536 that is disposed opposite surface 534 and is in fluid communication with actuator chamber 520. Mounting base 508 can also, optionally, include one or more passages formed therethrough and in fluid communication with the actuator chamber. For example, mounting base 508 can include a connection boss 538 that at least partially defines a passage 540. Additionally, or in the alternative, mounting base 508 can include a connection boss 542 that at least partially defines a passage 544. It will be appreciated that the arrangement of passages and connector bosses shown in FIGS. 17-19 is substantially similar to the arrangement of passages and connector bosses shown and described in FIGS. 13-16 in connection with mounting base 404 and that the detailed description provided above in connection therewith is equally applicable to the arrangement in FIGS. 17-19. As such, a detailed description is not repeated here.

Base portion 530 of mounting base 508 can at least partially define a base plane BPL (FIG. 18) and can optionally include one or more sections or areas that are disposed out of base plane BPL in an axial direction, such as toward or away from central portion 512 of flexible wall 510, for example. In the exemplary arrangement shown in FIGS. 17-19, base portion 530 includes an area, which is generally identified by item number 546, that is offset from base plane BPL in a direction toward central portion 512 of the flexible wall, as is indicated by reference line OF1 (FIG. 19), such that a recess 548 is formed along the exterior of mounting base 508. Offset area 546 is shown as including connection boss 542 such that passage 544 extends through base portion 530 along the offset area. One benefit of providing an area that is offset from base plane BPL, such as offset area 546, for example, is that internal or external recesses, such as recess 548, for example, can be formed thereby, such as may be useful for receiving additional components, for example. In the exemplary arrangement shown in FIGS. 17-19, a connector fitting 550 is operatively connected to connector boss 542 and in fluid communication with passage 544 and actuator chamber 520. Connector fitting 550 is accessible from along the exterior of pneumatic actuator 502 and is at least partially received within recess 548.

Though not shown in FIGS. 17-19, pneumatic actuator 502 can optionally include one or more securement features, such as may be useful in securing the pneumatic actuator to an associated element, component and/or structure, such as has been described above in connection with pneumatic actuators 100, 200, 302 and 400, for example. Also, though not shown in FIGS. 17-19, pneumatic actuator 502 can optionally include a support plate secured in abutting engagement on or along an exterior surface of the mounting base, such as has been described above in connection with pneumatic actuator 400, for example. Additionally, or in the alternative, support pad 504 can be used to operatively secure the pneumatic actuator to an associated element, component or structure, such as associated support structure SST (FIGS. 1 and 2), for example.

Support pad 504 can include a support pad wall 552 that can be formed from any suitable material or combination of materials, such as has been described above in connection with support pad 304, for example. Additionally, it will be appreciated that support pad wall 332 can be formed in any suitable manner and/or through the use of any one or more manufacturing processes or steps that may be suitable for forming the support pad wall. As one example, the support pad wall could be overmolded over or otherwise along at least a portion of the mounting base (e.g., mounting base 508). Optionally, one or more surface treatments (e.g., surface roughening, applying a sizing agent or primer) can be applied on or along at least a portion of the mounting base. As another example, the support pad wall could be formed from one or more wall portions that are separately or together attached, bonded or otherwise secured to at least a portion of the mounting base (e.g., mounting base 508), such as by using an adhesive material, for example.

While it will be appreciated that other configurations could alternately be used, support pad wall 552 is shown in FIGS. 17-19 as including a base portion 554 and a side portion 556. In the arrangement shown and described in FIGS. 17-19, support pad 504 is illustrated as being molded or otherwise formed as a single contiguous and/or unitary construction in which side portion 556 is integrally formed with base portion 554. As can be more clearly seen in FIGS. 18 and 19, base portion 554 includes a surface 558 that at least partially forms an exterior of support pad 504 and an opposing surface 560. In the embodiment shown, surfaces 558 and 560 are smooth and approximately planar. It will be appreciated, however, that surfaces 558 and 560 could be non-planar in cross-sectional shape and/or could be textured, such as may be useful for reducing slippage, for example.

Side portion 556 is shown as extending in an approximately axial direction from base portion 554 and terminating at an end surface 562 that extends approximately transverse to axis AX (FIGS. 1, 2, 5, 6, 15 and 16). Side portion 556 also includes a surface 564 (FIG. 18) that at least partially forms an exterior of support pad 504 and a surface 566 (FIG. 18) disposed generally opposite surface 564. Surfaces 562-566 can be smooth or, alternately, one or more of the surfaces can be textured. Surfaces 558, 562 and 564 can at least partially form an exterior of support pad 504. Additionally, surfaces 560 and 566 can at least partially form a support pad cavity (not numbered) that is dimensioned to receive and retain at least a portion of pneumatic actuator 502, such as, for example, has been described above in detail in connection with support pad 304 in FIGS. 9-12.

It will be appreciated that the operative interengagement between pneumatic actuator 502 and support pad 504 can be the same as or substantially similar to the operative interengagement between pneumatic actuator 302 and support pad 304 of assembly 300, which has been described above in detail in connection with FIGS. 9-12. As such, a more detailed description of the interengagement between pneumatic actuator 502 and support pad 504 of assembly 500 is not provided here for purposes of brevity. However, it is to be distinctly understood that the foregoing descriptions of pneumatic actuator 302, support pad 304 and the operative interengagement therebetween are equally applicable to pneumatic actuator 502 and support pad 504 and that any combination of any one or more of the details, structures and/or characteristics described above with regard to pneumatic actuator 302, support pad 304 and/or the operative interengagement therebetween can be applied to or included as features, structures and/or characteristics of pneumatic actuator 502, support pad 504 and/or the operative interengagement therebetween.

Support pad 504 is shown in FIGS. 17-19 as including certain features and/or structures that differ from those described above in connection with support 304. For example, support pad 504 can optionally include one or more access features that permit one or more features, elements and/or components of the mounting base (e.g., mounting base 508) to be accessed while the pneumatic actuator is operatively interengaged with the support pad. For example, support pad 504 is shown as including an access feature 568 that includes an opening portion 570 that extends through support pad wall 552 and provides access to passage 540, such as for providing a pressurized gas line connection, for example. Access feature 568 can also include a channel portion 572 that is formed into support pad wall 552, such as from along surface 558, for example, and extends from an outer periphery of the support pad wall inwardly and into communication with opening portion 570, such as, for example, for providing clearance for a pressurized gas line or for providing clearance for the connection of an electrical signal transmission line (e.g., a wire) of a sensor (not shown) that may be operatively connected with the pneumatic actuator through passage 540.

Additionally, or in the alternative, a support pad in accordance with the subject matter of the present disclosure, such as support pad 504, for example, can optionally include a communication feature that at least partially defines a fluid passage adapted to permit a pressurized gas line or other component to connect in fluid communication with the pneumatic actuator. In the arrangement shown in FIGS. 17-19, for example, support pad wall 552 includes a communication feature, which is generally identified by item number 574. Communication feature 574 is shown as including a fluid communication passage 576 that extends through the support pad wall in a transverse direction with respect to axis AX (FIGS. 1, 2, 5, 6, 15 and 16) and in approximate alignment with surface 558 of the support pad wall. Communication feature 574 can, optionally, include a connection feature 578 that includes a connector wall 580 projecting outwardly from along surface 564 to a distal end 582. Connector wall 580 can define at east a portion 576A of passage 576.

As can be more clearly seen in FIG. 19, communication feature 574 can also, optionally, include a connection feature 584 that includes a connector wall 586 projecting in an approximately axial direction from along base portion 554 of support pad wall 552 to a distal end 588. Connector wall 586 at least partially defines a portion 576B of passage 576 that extends in an approximately aligned direction with respect to axis AX. In the exemplary embodiment shown in FIGS. 17-19, connector wall 586 is dimensioned to receivingly engage connector fitting 550 such that a substantially fluid-tight seal can be formed therebetween. Support pad wall 552 can optionally include a recess 590 formed into the support pad wall from along surface 560 and extending around connector wall 586, such as, for example, may be useful for receiving a distal end 592 of connector fitting 550 that extends outwardly beyond base plane BPL of mounting base 508.

Additionally, connector fitting 550 may, in some cases, be of a construction commonly referred to as a push-to-connect fitting that includes a collet or other component disposed along distal end 592 thereof that is adapted to release the fluid line or connector wall that is received within the connector fitting. In such case, displacement of the collet or other component (not shown) of the connector fitting would permit connector wall 586 of connection feature 584 to be removed from the connector fitting and thereby permitting separation of support pad 504 from pneumatic actuator 502. As such, support pad wall 552, such as along base portion 554 thereof, for example, can optionally include one or more access features that permit the collet or release component along distal end 592 of connector fitting 550 to be displaced. In the exemplary arrangement shown in FIG. 19, for example, base portion 554 of support pad wall 552 can include one or more passages 593 that extend through the support pad wall. It will be appreciated, however, that other arrangements could alternately be used.

Support pad 504 can also, optionally, include one or more tab portions that project outwardly from the support pad wall and include one or more openings for handling and/or securing the support pad and, thereby, the pneumatic actuator to an associated support structure, such as associated support structure SST (FIGS. 1 and 2), for example. In the exemplary arrangement shown in FIGS. 17-19, support pad 504 includes a plurality of tab portions 594 that project in a radially-outwardly direction from along support pad wall 552. Tab portions 594 include a tab wall 596 that extends from the support pad wall, such as in an outward direction from along surface 564 of side portion 556, for example. Tab walls 596 are shown as including an opening 598 extending therethrough, such as, for example, may be useful for receiving a securement device (e.g., fasteners FST in FIGS. 1 and 2) to thereby secure the pneumatic actuator and support pad assembly to an associated support structure (e.g., associated support structure SST in FIGS. 1 and 2).

Figure 20:
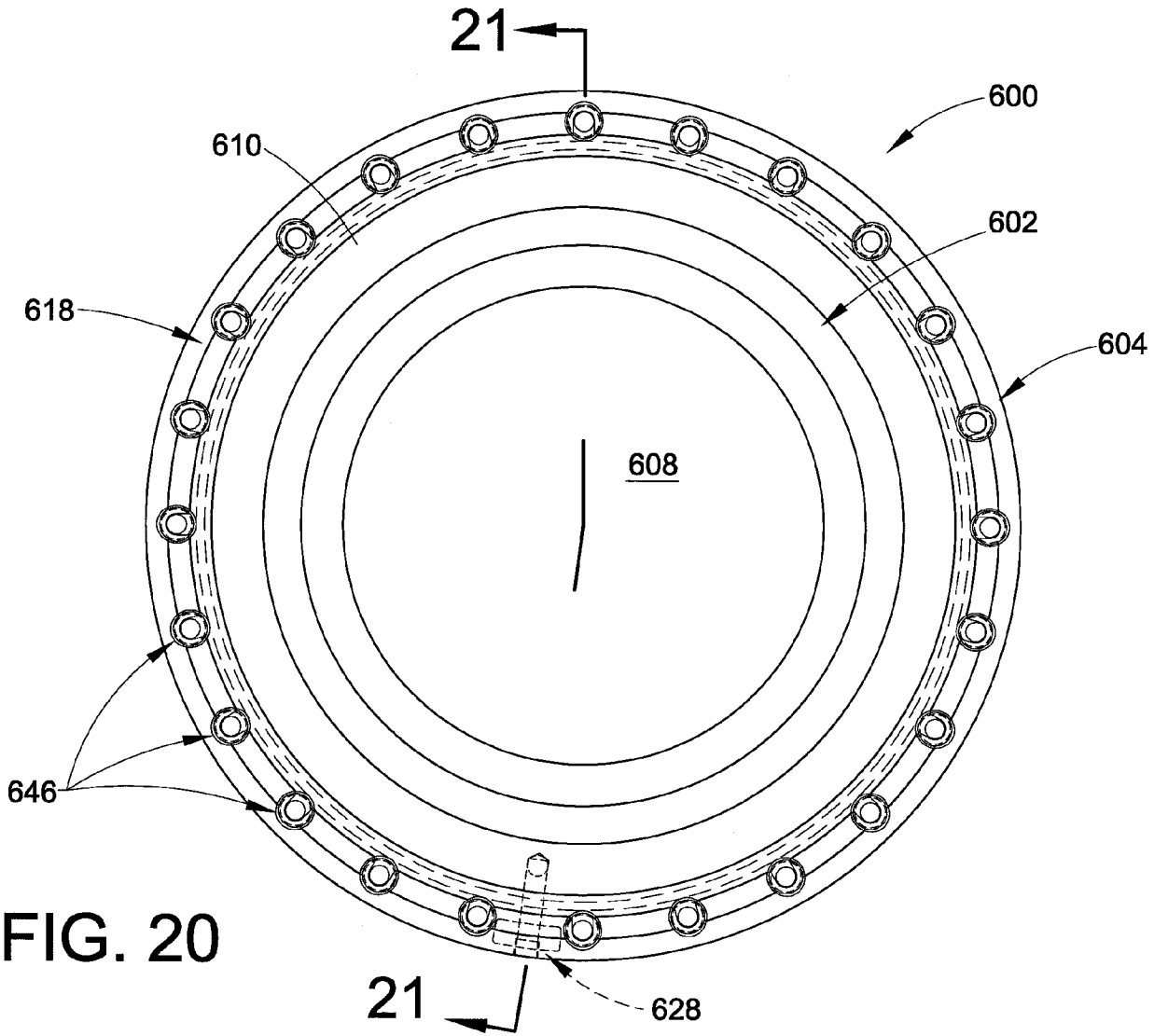
FIG. 20 is a top plan view of a further example of a pneumatic actuator in accordance with the subject matter of the present disclosure.
Figure 21:
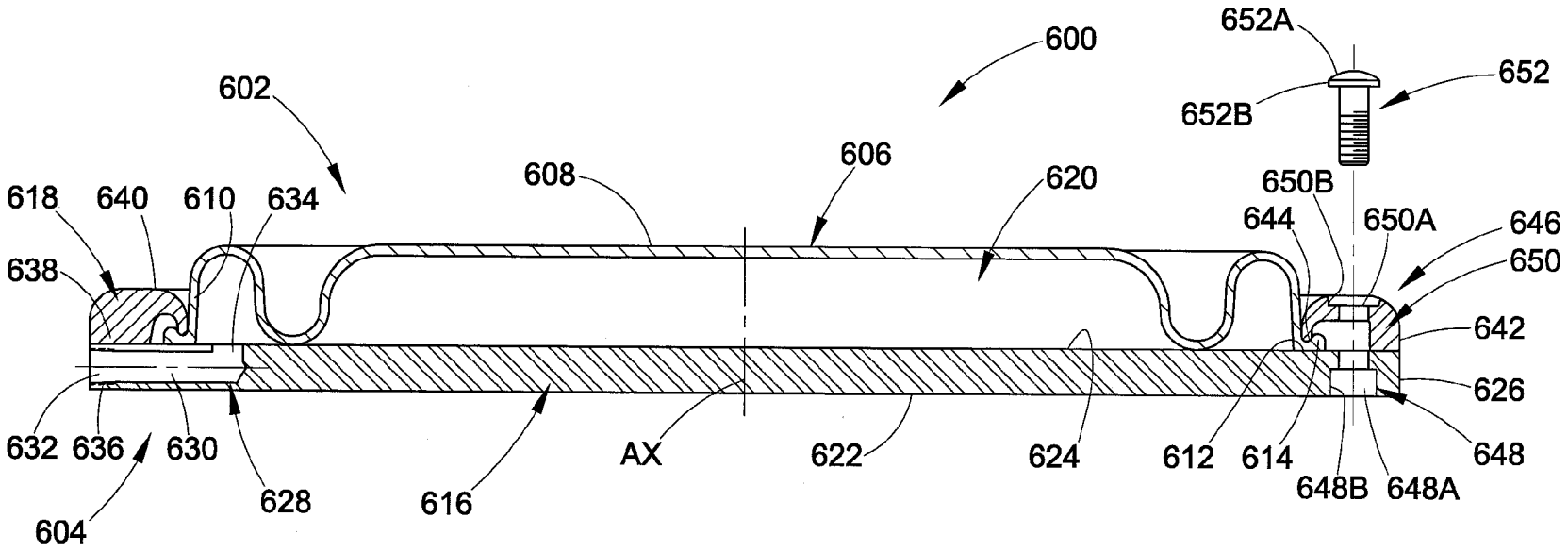
FIG. 21 is a cross-sectional side view of the exemplary pneumatic actuator in FIG. 20 taken from along line 21-21 thereof.

The foregoing embodiments shown and described above in connection with FIGS. 1-19 include a pneumatic actuator with a mounting base that has a bead portion integrally formed with the base portion of the mounting base, such as by being formed from a single, contiguous and/or unitary section of material (e.g., metal). An alternate construction is shown in FIGS. 20 and 21 in which a pneumatic actuator 600 has a longitudinally-extending axis AX and includes a flex member 602 and a mounting base 604. Flex member 602 includes a flexible wall 606 that is formed from polymeric material and includes a central portion 608 that at least partially defines a closed end (not numbered) of the flex member. A side portion 610 is disposed radially outwardly of the central portion and at least partially defines an open end (not numbered) of the flex member. Flexible wall 606 also includes an end surface 612 and a mounting bead 614. It will be recognized that flex member 602 is similar to flex members 102, 202, 306, 402 and 506, which have been described above in detail. As such, a more detailed description of flex member 602 is not provided here for purposes of brevity. However, it is to be distinctly understood that the foregoing descriptions of flex members 102, 202, 306, 402 and 506 are equally applicable to flex member 602 and that any combination of any one or more of the details and/or characteristics described above with regard to these other flex members can be included as a feature and/or structure of flex member 602.

Mounting base 604 differs from mounting bases 104, 204, 308, 404 and 508, which have been described in detail above, in that mounting base 604 includes a base portion 616 as well as a bead portion 618 that are separately provided from base portion 616. Even though mounting base 604 includes separate base and bead portions, a substantially fluid-tight seal is nonetheless preferably formed and maintained between the flex member and the mounting base such that an actuator chamber 620 is at least partially defined therebetween. One benefit of using a mounting base that includes a plurality of separable portions (e.g., base portion 616 and bead portion 618) is that an increased field of materials may be available for use in manufacturing the components of the mounting base. For example, base portion 616 and/or bead portion 618 could be formed from the same or different materials, or the same or different grades of a common material (e.g., different grades of a common family of polymeric materials having different hardness levels or durometers).

In the exemplary arrangement shown in FIGS. 20 and 21, base portion 616 includes a surface 622 that at least partially forms the exterior of the mounting base, a surface 624 opposite surface 622 that is in fluid communication with actuator chamber 620, and an outer peripheral edge or surface 626 that extends axially therebetween. Additionally, it will be appreciated that any number of the one or more other features and/or characteristics, alone or in any combination, that have been described above in connection with the embodiments shown in FIGS. 1-19 can be included as a feature or structure of mounting base 604, such as on or along base portion 616, for example.

As one example, base portion 616 can include a communication feature 628 that includes a fluid passage 630 that extends inwardly into the base portion from an opening 632 along surface 626, such as, for example, in a transverse direction with respect to axis AX and in approximate alignment with at least one of surfaces 622 and 624. An opening 634 is formed along surface 624 radially inwardly of side portion 610 and mounting bead 614 such that fluid passage 630 is in communication with actuator chamber 620. A connection feature (not numbered), such as may include a plurality of threads 636, for example, can be provided on or along base portion 616 in operative association with the communication feature.

In the exemplary arrangement shown in FIGS. 20 and 21, bead portion 618 includes a surface 638 disposed toward and in facing relation with surface 624 of base portion 616. A surface 640 is disposed opposite surface 638 and an outer peripheral edge or surface 642 extends generally between surfaces 638 and 640. Bead portion 618 also includes an end surface 644 disposed radially inwardly of surface 642 and dimensioned for receipt within a bead recess (e.g., bead recess 228 of flex member 202) of flex member 602. Upon urging bead portion 618 in a direction toward base portion 616, end surface 644 can be disposed in abutting engagement within the bead recess (not numbered) of flex member 602 and can urge surface 612, as well as any sealing features that may be optionally included (e.g., sealing features 220), into abutting engagement with surface 624 of base portion 616 such that a substantially fluid-tight seal can be formed therebetween.

It will be appreciated that preferred embodiments of the present exemplary construction will include the formation of a substantially fluid-tight seal between the flex member and the base portion of the mounting base, such as has been described in detail above. However, it will be recognized that other constructions could alternately be used. For example, the formation of a substantially fluid-tight seal could additionally, or in the alternative, be provided between the base portion and the bead portion of the mounting base and/or between the bead portion of the mounting base and the flex member. As one example, a substantially fluid-tight seal could be formed between bead portion 618 and flexible wall 606, such as along or adjacent mounting bead 614, for example. Additionally, a substantially fluid-tight seal could be formed by using a flowed-material joint to secure the base portion and the bead portion in fixed relation to one another. However, it will be recognized that so long as a substantially fluid-seal is formed between the flex member (e.g., flex members 102, 202, 306, 402 and 506) and the mounting base (e.g., mounting base 104, 204, 308, 404 and 508), other constructions could alternately be used.

For example, the bead portion of the mounting base could be removably secured to the base portion. In the arrangement shown in FIGS. 20 and 21, pneumatic actuator 600 includes a plurality of securement features 646 disposed circumferentially about axis AX along the outer peripheral edge of the mounting base. Base portion 616 can include a plurality of holes 648 extending into or through the base portion, such as from along surface 624, for example. Bead portion 618 can include a plurality of holes 650 extending into or through the base portion, such as from along surface 638, for example. In the exemplary arrangement shown in FIGS. 20 and 21, holes 648 and 650 extend through the base portion and the bead portion, respectively, with the holes being approximately aligned with one another. Holes 648 and/or 650 can be threaded to receivingly engage one of a plurality of securement devices, such as threaded fasteners 652, for example. Additionally, one or more of holes 648 and/or 650 can optionally include a recess 648A and/or 650A for receiving an outward portion of the threaded fastener, such as a head 652A, for example, that might otherwise project outwardly from base portion 616 and/or bead portion 618. If such recesses (e.g., recesses 648A and/or 650A) are provided, the recesses can, as one example, take the form of a counterbore or other feature having a side wall 6488 and/or 650B extending in approximate alignment with the corresponding hole. In such case, the recesses can, optionally, be dimensioned such that a friction fit between the side wall of the recesses and the outer periphery 652B of the head (e.g., head 652A) of the threaded fastener, such as may be useful for resisting backout of the threaded fastener, for example. It will be appreciated, however, that any other suitable arrangement for securement of the base portion and bead portion to one another could alternately be used.

As used herein with reference to certain features, elements, components and/or structures, numerical ordinals (e.g., first, second, third, fourth, etc.) may be used to denote different singles of a plurality or otherwise identify certain features, elements, components and/or structures, and do not imply any order or sequence unless specifically defined by the claim language. Additionally, the terms "transverse," and the like, are to be broadly interpreted. As such, the terms "transverse," and the like, can include a wide range of relative angular orientations that include, but are not limited to, an approximately perpendicular angular orientation.

Furthermore, the phrase "flowed-material joint" and the like are to be interpreted to include any joint or connection in which a liquid or otherwise flowable material (e.g., a melted metal or combination of melted metals) is deposited or otherwise presented between adjacent component parts and operative to form a fixed and substantially fluid-tight connection therebetween. Examples of processes that can be used to form such a flowed-material joint include, without limitation, welding processes, brazing processes and soldering processes. In such cases, one or more metal materials and/or alloys can be used to form such a flowed-material joint, in addition to any material from the component parts themselves. Another example of a process that can be used to form a flowed-material joint includes applying, depositing or otherwise presenting an adhesive between adjacent component parts that is operative to form a fixed and substantially fluid-tight connection therebetween. In such case, it will be appreciated that any suitable adhesive material or combination of materials can be used, such as one-part and/or two-part epoxies, for example.

Further still, terms such as "gas," pneumatic, and "fluid" as well as variants thereof, are used herein to broadly refer to and include any gaseous or vaporous fluid. Most commonly, air is used as the working medium of gas spring devices, such as those described herein, as well as suspension systems and other components thereof. However, it will be understood that any suitable gaseous fluid could alternately be used.

It will be recognized that numerous different features and/or components are presented in the embodiments shown and described herein, and that no one embodiment is specifically shown and described as including all such features and components. However, it is to be understood that the subject matter of the present disclosure is intended to encompass any and all combinations of the different features and components that are shown and described herein, and, without limitation, that any suitable arrangement of features and components, in any combination, can be used. Thus it is to be distinctly understood claims directed to any such combination of features and/or components, whether or not specifically embodied herein, are intended to find support in the present disclosure.

Thus, while the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations insofar as they come within the scope of the appended claims and any equivalents thereof.

The invention claimed is:

1. A pneumatic actuator and support pad assembly comprising:

a pneumatic actuator including:

a flex member including a central axis, a flexible wall and a connection feature disposed along said flexible wall, said connection feature including a connector wall that at least partially defines a connector passage, said flexible wall being formed from a polymeric material, said flexible wall including:

a central portion disposed in transverse relation to said central axis and at least partially defining a closed end of said flex member;

a side portion spaced radially-outwardly from said central portion and extending in approximate alignment with said central axis such that an open end of said flex member is at least partially defined by said side portion with said central portion and said side portion at least partially defining an actuator chamber such that said connector passage is disposed in fluid communication with said actuator chamber;

an end surface formed along said open end of said flexible wall and disposed in transverse relation to said central axis; and, a mounting bead spaced radially-outwardly from said side portion and least partially defining an outermost periphery of said flex member, said mounting bead including a bead recess surface extending radially-outwardly from along said side portion and a bead projection surface extending radially-outwardly from along said bead recess surface, said bead recess surface disposed in spaced relation to said end surface such that a recess dimension is formed therebetween and said bead projection surface disposed in spaced relation to said end surface such that a projection dimension is formed therebetween, said projection dimension being greater than said recess dimension such that a mounting recess is at least partially defined by said bead recess surface, said mounting recess extending along said flexible wall about said central axis; and, a mounting base operatively connected along the flex member such that a substantially fluid-tight seal is formed therewith along the end surface thereof and such that said actuator chamber is at least partially defined between said flex member and said mounting base, said mounting base including a base portion and a bead portion, said base portion of said mounting base disposed in transverse relation to said central axis of said flex member, said bead portion extending along said base portion of said mounting base about said central axis of said flex member, at least a part of said bead portion being received within said mounting recess and abuttingly engaging at least a part of said bead recess surface of said flex member such that at least a part of said end surface of said flex member is urged toward and into abutting engagement with said base portion of said mounting base to form said substantially fluid-tight seal between said flex member and said mounting base; and, a support pad abuttingly engaging at least a portion of said pneumatic actuator, said support pad including a support pad wall, said support pad wall including a base portion and a side portion projecting axially from along said base portion of said support pad wall, said base portion of said support pad wall including an outer surface adapted to abuttingly engage an associated support surface and an inner surface disposed opposite said outer surface, said side portion including an outer surface and an opposing inner surface, said inner surface of said base portion of said support pad wall and said inner surface of said side portion together at least partially defining a support pad cavity of said support pad; and, at least a portion of said pneumatic actuator being received within said support pad cavity of said support pad such that at least a portion of said mounting base abuttingly engages at least a portion of said inner surface of at least one of said base portion of said support pad wall and said side portion of said support pad wall.

2. A pneumatic actuator and support pad assembly according to claim 1, wherein said mounting base includes a fluid passage extending through said base portion of said mounting base and in fluid communication with said actuator chamber, and said support pad includes a fluid passage extending through a part of said support pad wall and in fluid communication with said actuator chamber through said fluid passage in said base portion of said mounting base.

3. A pneumatic actuator and support pad assembly according to claim 2, wherein said support pad wall includes a connector wall projecting outwardly from along one of said base portion and said side portion of support pad wall, said connector wall defining at least a portion of said fluid passage extending through said support pad wall.

4. A pneumatic actuator and support pad assembly according to claim 1, wherein said side portion of said support pad wall includes an end surface disposed opposite said outer surface of said base portion of said support pad wall, and said support pad wall includes a tube support portion projecting axially outwardly beyond said end surface of said side portion and including an opening extending therethrough that is dimensioned to receive an associated tube.

5. A pneumatic actuator and support pad assembly according to claim 4, wherein said tube support portion projects axially-outwardly from along said end surface of said side portion.

6. A pneumatic actuator and support pad assembly according to claim 1, wherein said flex member includes a connection feature disposed along said flexible wall, said connection feature including a connector wall that at least partially defines a connector passage fluidically isolated from said actuator chamber by a portion of said flexible wall.

7. A pneumatic actuator and support pad assembly according to claim 1, wherein said support pad includes a wall portion projecting outwardly from along said side portion in a direction transverse to said central axis of said flex member, said wall portion including an opening formed therethrough in a direction that is in approximate alignment with said central axis.

8. A method of assembling a pneumatic actuator, said method comprising:

a) providing a flex member that includes a central axis, a flexible wall and a connector wall projecting outwardly from along said flexible wall and at least partially defining a fluid passage, said flexible wall being formed from a polymeric material, said flexible wall including:
   - a central wall portion disposed in transverse relation to said central axis and at least partially defining a closed end of said flex member;
   - a side wall portion spaced radially-outwardly from said central wall portion and disposed in approximate alignment with said central axis such that an open end of said flex member is at least partially defined thereby;
   - an end surface formed along said open end of said flex member and disposed in transverse relation to said central axis; and,
   - a mounting bead spaced radially-outwardly from said side wall portion and at least partially defining an outermost periphery of said flex member, said mounting bead including a bead recess surface extending radially-outwardly from along said side wall portion and a bead projection surface extending radially-outwardly from along said bead recess surface, said bead recess surface disposed in spaced relation to said end surface such that a recess dimension is formed therebetween, said bead projection surface disposed in spaced relation to said end surface such that a projection dimension is formed therebetween, said projection dimension being greater than said recess dimension such that a mounting recess is at least partially defined by said bead recess surface with said mounting recess extending along said flexible wall about said central axis;

b) providing a mounting base that includes a base portion and a bead portion extending peripherally along said base portion;

c) positioning said mounting base such that said base portion is disposed adjacent said end surface of said flex member; and, d) positioning said bead portion of said mounting base within said mounting recess of said flexible wall; and, e) urging at least a portion of said bead portion toward said base portion such that at least a portion of said mounting bead is captured between said bead portion and said base portion and a substantially fluid-tight seal formed between said end surface and said base portion with an actuator chamber at least partially defined between said flex member and said mounting base.

9. A method according to claim 8, wherein said base portion and said bead portion of said mounting base are formed from a unitary section of material and the action of positioning in d) includes forming said bead portion from an outer peripheral portion of said unitary section of material.

10. A method according to claim 8, wherein the action of providing in b) includes providing a bead ring that is separable from said base portion with said bead ring including said bead portion, and said method further includes securing said bead ring to base portion.

11. A method according to claim 8, wherein said action of providing in a) includes providing a plurality of connector walls extending from along said flexible wall with at least one of said plurality of connector walls at least partially defining a fluid passage fluidically isolated from said actuator chamber by a portion of said flexible wall.

12. A method according to claim 11 further comprising connecting said fluid passage in fluid isolation from said actuator chamber with said actuator chamber.

13. A method according to claim 8 further comprising providing a support pad that includes a support pad wall at least partially defining a support pad cavity and interengaging said support pad and said pneumatic actuator such that at least a portion of said mounting base is received in said support pad cavity and abuttingly engages said support pad wall.

14. A method according to claim 13, wherein providing said support pad includes providing a support pad that includes a tube support portion projecting outwardly from said support pad wall and including an opening extending therethrough that is dimensioned to receive an associated tube.

15. A method according to claim 8, wherein said action of providing in a) includes providing a plurality of connector walls extending from along said flexible wall with at least one of said plurality of connector walls at least partially defining a fluid passage in fluid communication with said actuator chamber.

16. A pneumatic actuator comprising:

a flex member including a central axis, a flexible wall and a connector wall that projects outwardly from along said flexible wall and at least partially defines a fluid passage, said flexible wall being formed from a polymeric material, said flexible wall including;
   - a central wall portion disposed in transverse relation to said central axis and at least partially defining a closed end of said flex member;
   - a side portion spaced radially-outward from said central portion and extending in approximate alignment with said central axis such that an open end of said flex member is at least partially defined by said side portion;

an end surface formed along said open end of said flexible wall and disposed in transverse relation to said central axis; and, a mounting bead spaced radially-outward from said side portion and least partially defining an outermost periphery of said flex member, said mounting bead including a bead recess surface extending radially-outward from along said side portion and a bead projection surface extending radially-outward from along said bead recess surface, said bead recess surface disposed in spaced relation to said end surface such that a recess dimension is formed therebetween and said bead projection surface disposed in spaced relation to said end surface such that a projection dimension is formed therebetween, said projection dimension being greater than said recess dimension such that a mounting recess is at least partially defined by said bead recess surface with said mounting recess extending along said flexible wall about said central axis; and, a mounting base operatively connected along the flex member such that a substantially fluid-tight seal is formed therewith along the end surface thereof and such that an actuator chamber is at least partially defined between said flex member and said mounting base, said mounting base including a base portion and a bead portion, said base portion disposed in transverse relation to said central axis of said flex member, said bead portion extending along said base portion about said central axis of said flex member, at least a part of said bead portion being received within said mounting recess and abuttingly engaging at least a part of said bead recess surface of said flex member such that at least a part of said end surface of said flex member is urged toward and into abutting engagement with said base portion of said mounting base to form said substantially fluid-tight seal between said flex member and said mounting base.

17. A pneumatic actuator according to claim 16, wherein said flex member includes a sealing feature projecting outwardly from said end surface, and said sealing feature abuttingly engages said base portion of said mounting base.

18. A pneumatic actuator according to claim 16, wherein said base portion of said mounting base includes a first side disposed in abutting engagement with said end surface of said flex member and an opposing second side, and said mounting base includes at least one securement feature disposed along said base portion and accessible from along at least said second side of said base portion.

19. A pneumatic actuator according to claim 18, wherein said mounting base includes bead portion that is separable from said base portion of said mounting base, said bead portion including at least one securement feature that is cooperable with said at least one securement feature disposed along said base portion of said mounting base such that said bead portion can be operatively connected with said base portion of said mounting base and thereby urge said end surface of said flex member into abutting engagement with said base portion of said mounting base to form said substantially fluid-tight seal therebetween.

20. A pneumatic actuator according to claim 16, wherein said connector wall is a first connector wall and said fluid passage is a first fluid passage, and said flex member includes a second connector wall that at least partially defines a second connector passage that is fluidically isolated from said actuator chamber by a portion of said flexible wall.

* * * * *